US008491109B2

(12) United States Patent
Takeda et al.

(10) Patent No.: US 8,491,109 B2
(45) Date of Patent: Jul. 23, 2013

(54) CONTAINER UNIT AND LIQUID EJECTION SYSTEM

(75) Inventors: Yuki Takeda, Matsumoto (JP); Yoshiaki Shimizu, Matsumoto (JP); Taku Ishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 13/350,547

(22) Filed: Jan. 13, 2012

(65) Prior Publication Data

US 2012/0182364 A1 Jul. 19, 2012

(30) Foreign Application Priority Data

Jan. 14, 2011 (JP) ..... 2011-005856

(51) Int. Cl.
*B41J 2/175* (2006.01)

(52) U.S. Cl.
USPC ..... 347/85; 347/86

(58) Field of Classification Search
USPC ..... 347/85, 86
See application file for complete search history.

(56) References Cited

U.S. PATENT DOCUMENTS

| | | | | |
|---|---|---|---|---|
| 5,680,164 | A | 10/1997 | Miller et al. | |
| 6,007,191 | A | 12/1999 | Fujii et al. | |
| 6,942,326 | B2 * | 9/2005 | Hayashi et al. | 347/86 |
| 7,175,264 | B2 | 2/2007 | Qingguo et al. | |
| 7,625,078 | B2 * | 12/2009 | Steiger et al. | 347/86 |
| 7,891,790 | B2 * | 2/2011 | Nip | 347/87 |
| 2002/0075366 | A1 * | 6/2002 | Smith et al. | 347/86 |
| 2004/0227796 | A1 | 11/2004 | Yuen | |
| 2006/0146105 | A1 | 7/2006 | Hayashi et al. | |

FOREIGN PATENT DOCUMENTS

| | | | |
|---|---|---|---|
| EP | 1013446 | A2 | 6/2000 |
| EP | 1905596 | A1 | 4/2008 |
| GB | 2460862 | A | 12/2009 |
| JP | 2005-219483 | A | 8/2005 |
| WO | 2007/086848 | A1 | 8/2007 |

* cited by examiner

*Primary Examiner* — Anh T. N. Vo
(74) *Attorney, Agent, or Firm* — Kilpatrick Townsend & Stockton LLP

(57) ABSTRACT

There is provided a container unit located outside of a liquid ejection apparatus and configured to supply a liquid to the liquid ejection apparatus via a connection path. The container unit includes: a liquid container configured to contain the liquid, the liquid container having a liquid fill port for pouring the liquid into the liquid container; and a bottom cover member attached to the liquid container and configured to form a bottom face that comes into contact with a mounting surface of the container unit in a liquid supply attitude of the liquid container, in which the liquid is supplied to the liquid ejection apparatus. The bottom cover member has a liquid retainer provided on an opposed face to retain the liquid flow into the opposed face, the opposed face being provided on an opposite side to the bottom face and being opposed to the liquid container.

11 Claims, 19 Drawing Sheets

CONTAINER UNIT AND LIQUID EJECTION SYSTEM

This application claims priority to Japanese Patent Application No. 2011-005856, filed Jan. 14, 2011, the entirety of which is incorporated by reference herein.

TECHNICAL FIELD

The present invention relates to a container unit and a liquid ejection system including the container unit.

BACKGROUND ART

A printer as one example of liquid ejection apparatus ejects ink from a recording head onto a recording object (for example, print sheet) for printing. A known technique for ink supply to the recording head supplies ink from a container unit located outside of the printer to the recording head via a tube (for example, PTL1). This container unit has a liquid fill port for pouring ink into the container unit.

CITATION LIST

[Patent Literature]
[PTL 1]
JP-A-2005-219483

SUMMARY

[Technical Problem]

During pour of ink through the liquid fill port into the container unit, ink may adhere to the surface of the container unit. The ink adhering to the surface of the container unit may be dripped onto the mounting surface, such as desktop, and stain the mounting surface. For example, ink overflowing from the liquid fill port during ink pouring may adhere to the surface of the container unit and then be dripped onto the mounting surface. In another example, the user may accidentally fall drops of ink at a position other than the liquid fill port during ink pouring. These ink drops may adhere to the surface of the container unit and then be dripped onto the mounting surface.

These problems are not characteristic of the container unit for supplying ink the printer but is commonly found in any container unit containing a liquid to be ejected from a corresponding liquid ejection apparatus and having a liquid fill port for pouring the liquid into the container unit.

Consequently, in order to address the problems described above, there is a need to reduce the possibility that the liquid flows out of a container unit having a liquid fill port.

[Solution to Problem]

In order to address at least part of the foregoing problems, the present invention provides various aspects and embodiments described below.

First Aspect

A container unit located outside of a liquid ejection apparatus and configured to supply a liquid to the liquid ejection apparatus via a connection path, comprising:

a liquid container configured to contain the liquid, the liquid container having a liquid fill port for pouring the liquid into the liquid container; and a bottom cover member attached to the liquid container and configured to form a bottom face that comes into contact with a mounting surface of the container unit in a liquid supply attitude of the liquid container, in which the liquid is supplied to the liquid ejection apparatus, wherein the bottom cover member has a liquid retainer provided on an opposed face to retain the liquid flow into the opposed face, the opposed face being provided on an opposite side to the bottom face and being opposed to the liquid container.

In the container unit according to the first aspect, the bottom cover member has the liquid retainer. This reduces the possibility that the liquid dripped on the bottom cover member flows out of the container unit.

Second Aspect

The container unit according to the first aspect, wherein the liquid retainer is a recess formed on the opposed face.

In the container unit according to the second aspect, the bottom cover member has the recess to retain the liquid. This reduces the possibility that the liquid flows out of the bottom cover member.

Third Aspect

The container unit according to the second aspect, wherein the bottom cover member is a vertically-angled relative to the mounting surface in a liquid receiving attitude of the container unit, in which the liquid is poured into the liquid container, and the recess includes a first concave formed in a groove shape and extended in a first direction including a horizontal component in the liquid receiving attitude.

In the container unit according to the third aspect, the recess includes the first concave formed in a groove shape and extended in the first direction in the liquid receiving attitude. This prevents the liquid present in the first concave provided on the bottom cover member from moving vertically downward by gravity, thus reducing the possibility that the liquid flows out of the container unit.

Fourth Aspect

The container unit according to the third aspect, wherein the recess includes a second concave formed in a groove shape to cross the first concave and extended in a second direction including a vertical component in the liquid receiving attitude.

In the container unit according to the fourth aspect, the recess includes the second concave formed in a groove shape to cross the first concave. Part of the liquid in the first concave can thus be moved to the second concave. This decreases the possibility that a large volume of the liquid retains in a specific part of the bottom cover member. This enhances vaporization of the liquid present on the bottom cover member and thereby further reduces the possibility that the liquid flows out of the container unit.

Fifth Aspect

The container unit according to the fourth aspect, wherein the bottom cover member comprises a plurality of the first concaves and a plurality of the second concaves, and the plurality of first concaves and the plurality of second concaves are arranged to form a lattice-like pattern.

In the container unit according to the fifth aspect, the plurality of first concaves and the plurality of second concaves are arranged to form the lattice-like pattern, so as to enhance the diffusion of the liquid throughout the plurality of first concaves and the plurality of second concaves. This enhances the diffusion of the liquid retained in the concaves and accelerates vaporization of the liquid present on the bottom cover member, thus further reducing the possibility that the liquid flows out of the container unit.

Sixth Aspect

The container unit according to the fourth aspect, wherein the bottom cover member comprises a plurality of the first concaves and a plurality of the second concaves, and the plurality of second concaves are arranged in zigzag.

In the container unit according to the sixth aspect, the plurality of second concaves are arranged in zigzag. This arrangement enhances the diffusion of the liquid throughout the plurality of first concaves via the plurality of second concaves. This accelerates vaporization of the liquid retained in the concaves and thus further reduces the possibility that the liquid flows out of the container unit.

Seventh Aspect

The container unit according to any one of the first aspect to the sixth aspect, wherein the bottom cover member further comprises:

an opening or a notch formed to penetrate from the opposed face to the bottom face; and a circumferential rim provided on the opposed face side to surround periphery of the opening or the notch and protruded from the opposed face.

The container unit according to the seventh aspect has the circumferential rim provided around the opening or notch. This further decreases the possibility that the liquid flows out of the container unit via the opening or notch.

Eighth Aspect

The container unit according to the second aspect, wherein the bottom cover member further comprises:

a plurality of openings or notches formed to penetrate from the opposed face to the bottom face; and a third concave formed in a groove shape and extended along an imaginary line without crossing the imaginary line, the imaginary line successively connecting the plurality of adjacent openings or notches.

The container unit according to the eighth aspect has the third concave formed in a groove shape and extended along the imaginary line of successively connecting the plurality of openings or notches. The third concave interferes with the flow of the liquid toward the opening or the notch and thereby reduces the possibility that the liquid reaches the opening or the notch. This decreases the possibility that the liquid flows out of the container unit via the opening or notch.

Ninth Aspect

The container unit according to the eighth aspect, wherein the bottom cover member further comprises:

a plurality of circumferential rims, each being provided on the opposed face side to surround periphery of each of the plurality of openings or notches and being protruded from the opposed face.

The container unit according to the ninth aspect has the circumferential rims provided around the respective openings or notches. This further decreases the possibility that the liquid flows out of the container unit via the opening or notch.

Tenth Aspect

The container unit according to any one of the first aspect to the ninth aspect, wherein the bottom cover member further comprises a cover wall member projecting from periphery of the bottom cover member toward a side on which the liquid container is mounted.

In the container unit according to the tenth aspect, the bottom cover member has the cover wall member. Even when the liquid is present near the periphery of the bottom cover member, the cover wall member blocks the flow of the liquid toward outside the container unit. This further decreases the possibility that the liquid flows out of the container unit.

Eleventh Aspect

A liquid ejection system, comprising:

the container unit according to any one of the first aspect to the tenth aspect;

the liquid ejection apparatus having a head for ejecting the liquid onto an object; and the connection path arranged to connect the container unit to the liquid ejection apparatus and supply the liquid contained in the container unit to the liquid ejection apparatus.

In the liquid ejection system according to the eleventh aspect, the container unit having the reduced possibility that the liquid flows out of the container unit may be used to supply the liquid to the liquid ejection apparatus.

The present invention may be implemented by diversity of aspects and embodiments in addition to the container unit and the liquid ejection system including the container unit and the liquid ejection apparatus, for example, a manufacturing method of the container unit and a liquid ejection method using the liquid ejection system.

The prevent application claims the priority based on Japanese Patent Application No. 2011-5856 filed on Jan. 14, 2011, the disclosure of which is hereby incorporated by reference in its entirety.

DESCRIPTION OF EMBODIMENTS

Illustrative embodiments of the invention are described below in the following sequence:

A, B: Embodiments

C: Modifications

A. First Embodiment

A-1. General Configuration of Liquid Ejection System

Figure 1A:
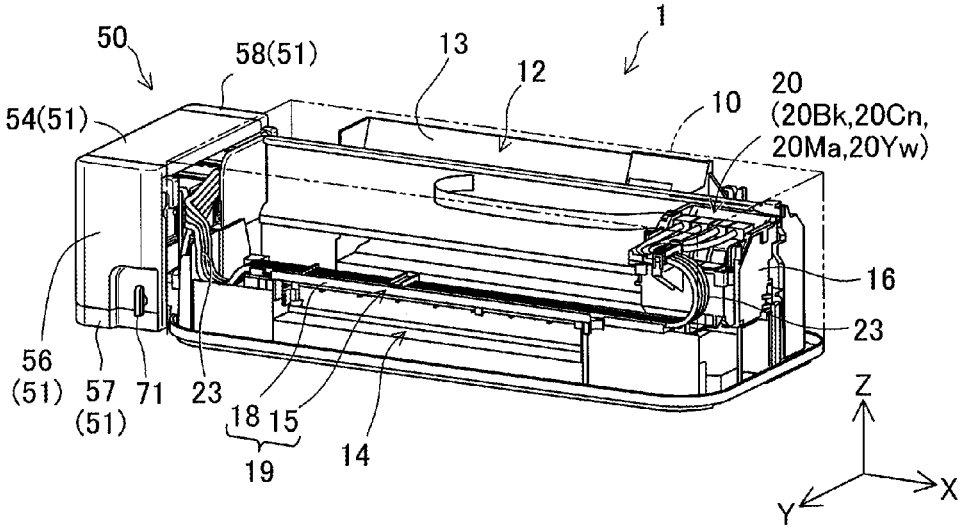
FIG. 1A illustrates a first appearance perspective view of the liquid ejection system 1.
Figure 1B:
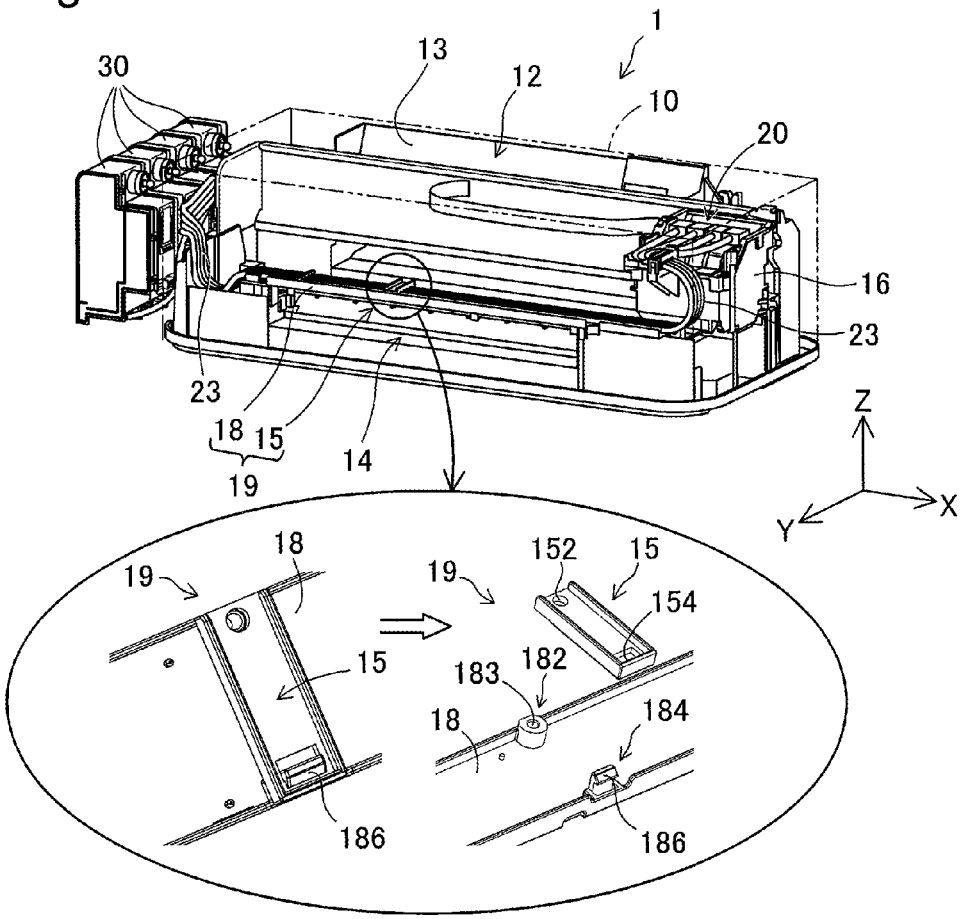
FIG. 1B illustrates a second appearance perspective view of the liquid ejection system 1.

FIGS. 1A and 1B illustrate a liquid ejection system 1 according to a first embodiment of the invention. FIG. 1A is a first appearance perspective view of the liquid ejection system 1. FIG. 1B is a second appearance perspective view of the liquid ejection system 1. In the view of FIG. 1B, cover members 51 are omitted from a container unit 50 illustrated in FIG. 1A. FIG. 1B also includes partial enlarged views showing the details of a hose fixation mechanism 19. Illustration of hoses 23 is omitted from the partial enlarged views of FIG. 1B. XYZ axes orthogonal to one another are shown in FIGS. 1A and 1B for the purpose of specifying the respective directions. In the subsequent drawings, the XYZ axes orthogonal to one another are shown according to the requirements.

As shown in FIG. 1A, the liquid ejection system 1 includes an inkjet printer 12 (hereinafter simply called "printer 12") as the liquid ejection apparatus, and the container unit 50. The printer 12 has a paper feed assembly 13, a paper discharge assembly 14, a carriage (sub-tank attachment unit) 16 and four sub-tanks 20. The four sub-tanks 20 respectively contain different color inks. Specifically, the four sub-tanks 20 include a sub-tank 20Bk containing black ink, a sub-tank 20Cn containing cyan ink, a sub-tank 20Ma containing magenta ink and a sub-tank 20Yw containing yellow ink. These four sub-tanks 20 are mounted on the carriage 16.

A print sheet set in the paper feed assembly 13 is transported through inside of the printer 12 for printing and is discharged after printing from the paper discharge assembly 14.

The carriage 16 is movable in a main scanning direction (i.e., paper width direction or X-axis direction). The driving force of a stepping motor (not shown) is transmitted via a timing belt (not shown) to move the carriage 16. Recording heads (not shown) are provided on the lower face of the carriage 16. Ink is ejected for printing from a plurality of nozzles provided on each of the recording heads onto the print sheet. The respective parts of the printer 12, for example, the timing belt and the carriage 16, are placed in a casing 10 to be protected.

As illustrated in FIGS. 1A and 1B, the container unit 50 includes cover members 51, ink tanks 30 as liquid containers, and a valve unit (not shown in FIG. 1; described later). Referring to FIG. 1A, the cover members 51 include a top cover member 54, a first side cover member 56, a second side cover member 58, a bottom cover member 57, and a coupling cover member (not shown in FIG. 1; described later). The ink tanks 30, the respective color members 54, 56, 57 and 58, and the coupling cover member may be made of a synthetic resin, such as polypropylene (PP) or polystyrene (PS). The coupling cover member and the respective cover members 54, 56, 57 and 58 may be colored in a preset color (for example, black) and are opaque. The ink tanks 30 are, on the other hand, translucent to make the state of ink (ink level) visible from the outside. The ink tanks 30 are partly surrounded and protected by the cover members 51. Attachment of the bottom cover member 57 to the ink tanks 30 enables the container unit 50 to be more stably placed on a preset mounting surface (for example, on the horizontal plane of a desk or a shelf).

The four ink tanks 30 respectively contain color inks corresponding to the color inks contained in the four sub-tanks 20. More specifically, the four ink tanks 30 respectively contain black ink, cyan ink, magenta ink and yellow ink. Each of the ink tanks 30 is designed to allow the state of ink to be visually checked from the outside through a specified part. The ink tanks 30 have the greater ink capacities than those of the sub-tanks 20.

The liquid ejection system 1 further includes four hoses (tubes) 23 as flow conduits. Each of the hoses 23 connects the ink tank 30 containing one color ink with the sub-tank 20 containing the corresponding color ink. The hoses 23 are made of a flexible material, such as synthetic rubber. As ink contained in the sub-tank 20 is ejected from the recording head and is consumed, the corresponding ink contained in the ink tank 30 is supplied to the corresponding sub-tank 20 via the hose 23. The liquid ejection system 1 can thus continue printing for a long period of time without interruption. Instead of providing the sub-tanks 20, ink may be supplied directly from the ink tanks 30 through the hoses 23 to the recording heads. The internal flow path of the hose 23 may be opened and closed by rotating a handle 71 provided as part of the valve unit as described later in detail.

As illustrated in FIG. 1B, the printer 12 also has the hose fixation mechanism 19 for fixing part of the hoses 23. The hose fixation mechanism 19 includes a rail 18 extended in the main scanning direction (i.e., paper width direction or X-axis direction) and a retainer plate 15 attached to the rail 18. Part of the hoses 23 is mounted on the rail 18 and is clamped between the retainer plate 15 and the rail 18.

As shown in the right of the two partial enlarged views of FIG. 1B, the rail 18 includes a first rail fixation element 182 and a second rail fixation element 184. The first rail fixation element 182 is formed in a cylindrical shape protruded upward from the mounting surface of the rail 18, on which the hoses 23 are mounted, and has a threaded hole 183. The second rail fixation element 184 is protruded upward from the mounting surface of the rail 18 and has a fitting element 186 provided at one end to fit in the retainer plate 15. The retainer plate 15 is a flat plate extended in the width direction (i.e., shorter-side direction or Y-axis direction) of the rail 18. The retainer plate 15 has a threaded hole 152 formed at one end, and a through hole 154 formed at the other end, in which the second rail fixation element 184 is fit. The retainer plate 15 is secured to the rail 18 by insertion of the fitting element 186 into the through hole 154 and screw fixation in the threaded holes 152 and 183. Part of the hoses 23 mounted on the rail 18 is clamped between the retainer plate 15 and the rail 18 and is fixed inside the printer 12. According to another embodiment, the through hole 154 formed at the other end of the retainer plate 15 may be replaced by another threaded hole similar to the threaded hole formed at one end. In this embodiment, a threaded hole may be correspondingly formed in the rail 18, and part of the hoses 23 may be clamped between the retainer plate 15 and the rail 18 by screw fixation in these threaded holes.

Figure 2:
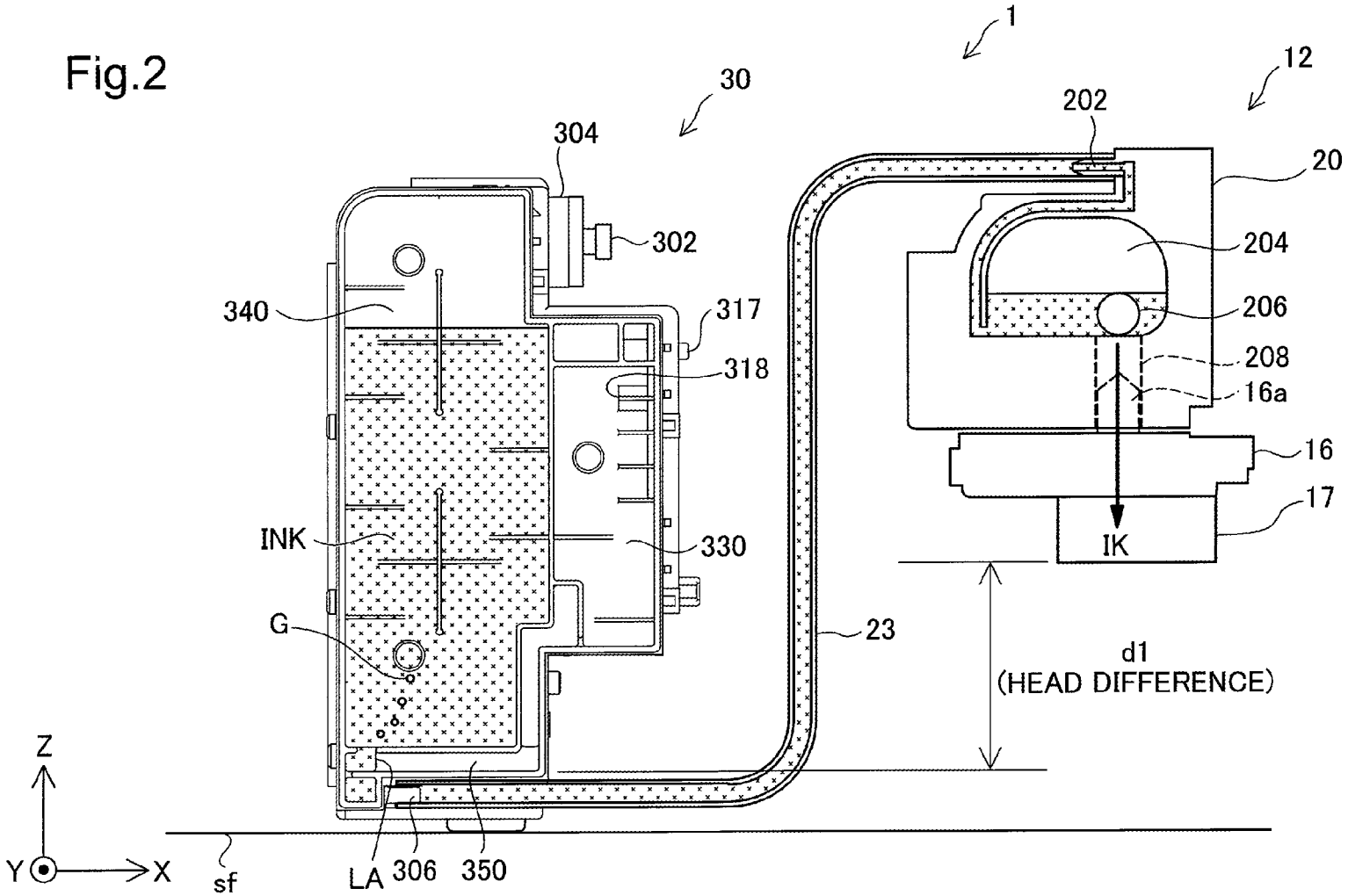
FIG. 2 illustrates the principle of ink supply.

FIG. 2 illustrates the principle of ink supply from the ink tank 30 to the sub-tank. FIG. 2 shows the ink tank 30, seen from the Y-axis positive direction. FIG. 2 also schematically illustrates inside of the hose 23 and the printer 12.

The liquid ejection system 1 is located on a predetermined horizontal plane (mounting surface) sf. A liquid discharge port 306 of the ink tank 30 is connected with a liquid receiving port 202 of the corresponding sub-tank 20 via the hose 23. The sub-tanks 20 are made of a synthetic resin, such as polystyrene or polyethylene. The sub-tank 20 includes an ink reserving chamber 204, an ink fluid path 208 and a filter 206. An ink supply needle 16*a* of the carriage 16 is inserted into the ink fluid path 208. The filter 206 traps any foreign matter or impurity included in ink and thereby prevents the impurity from flowing into a recording head 17. Suction of ink from the recording head 17 causes the ink retained in the ink reserving chamber 204 to flow through the ink fluid path 208 and the ink supply needle 16*a* to the recording head 17. The ink supplied to the recording head 17 is ejected through the nozzles to the outside (print sheet).

The ink tank 30 includes a liquid chamber 340 containing ink, an air chamber 330 containing the air, and a liquid connection path (also called "second flow path") 350 for connecting the liquid chamber 340 with the air chamber 330. In the liquid supply attitude of the ink tank 30 during ink supply to the printer 12, the liquid connection path 350 has a certain flow path cross-sectional area allowing for formation of the meniscus. In the liquid supply attitude, the ink is thus retained in the liquid connection path 350.

The liquid chamber 340 has a liquid fill port 304, which is closed by a plug member 302. During ink supply to the printer 12, the liquid fill port 304 is sealed with the plug member 302. The liquid chamber 340 is kept in negative pressure during the liquid supply. The air chamber 330 communicates with the atmosphere (outside) via an air chamber opening 318 to be kept in the atmospheric pressure. The air chamber opening 318 communicates with an air inlet 317 open to the outside. In the liquid supply attitude, the liquid connection path 350 is located at a lower position than the recording head 17. This causes a head difference d1. In the liquid supply attitude, the head difference d1 in the state that the meniscus is formed in the liquid connection path 350 is called "stationary head difference d1".

Suction of the ink in the ink reserving chamber 204 by the recording head 17 causes the ink reserving chamber 204 to be in negative pressure of not less than a certain level. When the ink reserving chamber 204 has the negative pressure of or over the certain level, the ink in the liquid chamber 340 is supplied through the hose 23 to the ink reserving chamber 204. The amount of ink corresponding to the amount supplied to the recording head 17 is automatically poured from the liquid chamber 340 into the ink reserving chamber 204. In other words, when the suction force (negative pressure) from the printer 12 becomes greater by a certain amount than the head difference dl caused by the height difference in the vertical direction between the ink level LA exposed to the air chamber 330 (i.e., atmosphere) in the ink tank 30 (atmosphere-exposed liquid level LA) and the recording head 17 (more specifically, the nozzles), ink is supplied from the liquid chamber 340 to the ink reserving chamber 204.

As the ink in the liquid chamber 340 is consumed, the air G (also called "air bubbles G") in the air chamber 330 is introduced through the liquid connection path 350 to the liquid chamber 340. This lowers the liquid level in the liquid chamber 340. When the liquid level is lowered to decrease the amount of ink in the liquid chamber 340 to or below a preset level, ink should be poured through the liquid fill port 304 into the ink tank 30 by, for example, the user.

Figure 3A:
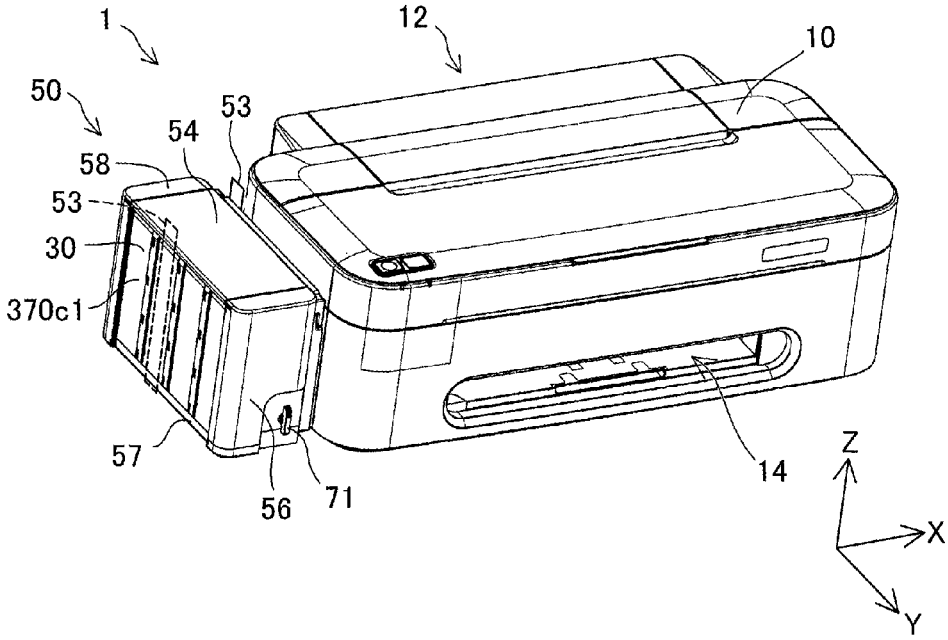
FIG. 3A illustrates the liquid ejection system 1 with the ink tank 30 in the liquid supply attitude.
Figure 3B:
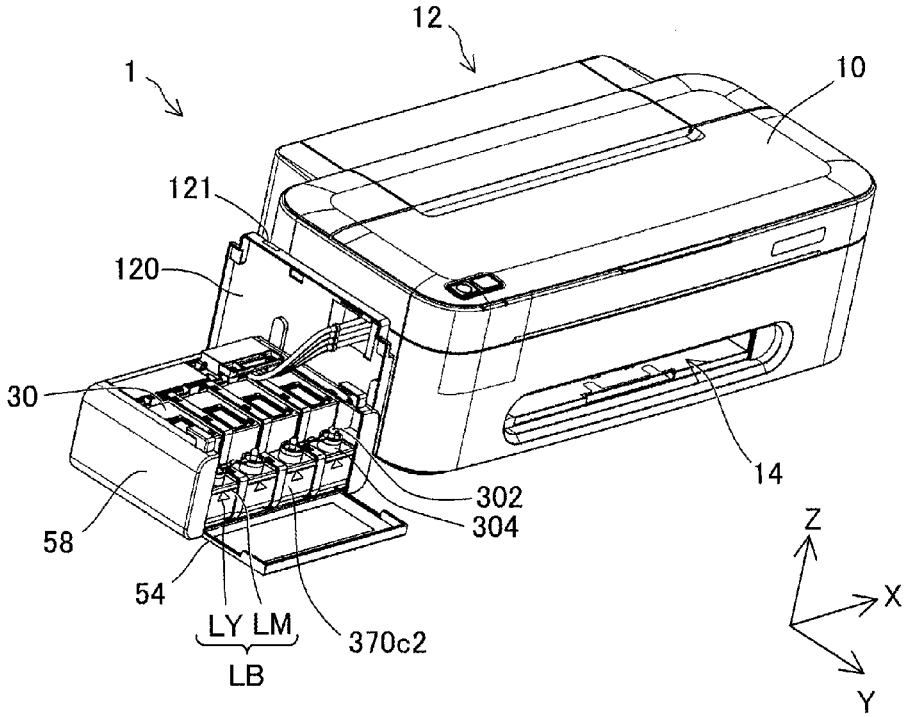
FIG. 3B illustrates the liquid ejection system 1 with the ink tank 30 in the liquid receiving attitude during ink pouring.

The liquid ejection system 1 is described more with reference to FIGS. 3A and 3B. FIG. 3A illustrates the liquid ejection system 1 with the ink tank 30 in the liquid supply attitude. FIG. 3B illustrates the liquid ejection system 1 with the ink tank 30 in the liquid receiving attitude during ink pouring.

As illustrated in FIG. 3A, in the liquid supply attitude, the ink tank 30 is set in the state that a partial wall member (first wall member) 370*c*1 is visible from the outside. In the liquid supply attitude, the first wall member 370*c*1 is vertically-angled relative to the mounting surface. According to this embodiment, the first wall member 370*c*1 is arranged to be substantially perpendicular to the mounting surface.

The liquid ejection system 1 includes a ruler 53 as the measuring instrument for detecting the amount of ink in the ink tank 30. The ruler 53 has scale marks at preset intervals. As shown in FIG. 3B, the printer 12 has a fixation member 120 provided on the side face for attachment of the container unit 50. The ruler 53 is placed in the fixation member 120. More specifically, the ruler 53 is inserted and received in an opening 121 formed in one side face (upper face in this embodiment) of the fixation member 120.

In measurement of the ink level in the ink tank 30 as shown in FIG. 3A, the user take the ruler 53 out of the opening 121 and locates the ruler 53 along the first wall member 370*c*1 to measure the ink level in the ink tank 30. When the ink level is lowered to or below a preset threshold level, the user pours ink into the ink tank 30. More specifically, as shown in FIG. 3B, the attitude of the ink tank 30 is changed from the liquid supply attitude to the liquid receiving attitude, in which the liquid fill port 304 is open upward in the vertical direction (i.e., Z-axis positive direction). The user then opens the top cover member 54, removes the plug member 302 from the liquid fill port 304, and pours ink through the liquid fill port 304 into the ink tank 30.

Opening the top cover member 54 causes a second wall member 370*c*2 different from the first wall member 370*c*1 to be visible from the outside. The second wall member 370*c*2 is vertically-angled relative to the mounting surface in the liquid receiving attitude of the ink tank 30. According to this embodiment, the second wall member 370*c*2 is arranged to be substantially perpendicular to the mounting surface in the liquid receiving attitude.

The second wall member 370*c*2 has an upper limit element LB indicating sufficient ink pouring into the ink tank 30. The upper limit element LB includes an upper limit line LM that runs horizontally in the liquid receiving attitude of the container unit 50, and a triangle arrow LY showing the position of the upper limit line LM. The upper limit line LM is provided to indicate that the ink level in the ink tank 30 reaches a second threshold level.

The user fills or pours ink into the ink tank 30 until the ink level sufficiently approaches the upper limit line LM. After pouring ink, the user changes the attitude of the ink tank 30 to the liquid supply attitude shown in FIG. 3A and re-inserts and stores the ruler 53 into the opening 121. As described above, providing the ruler 53 and the upper limit element LB enables the user to readily check the ink level in the ink tank 30 in each of the attitudes.

A-2. General Structure of Container Unit 50

Figure 4A:
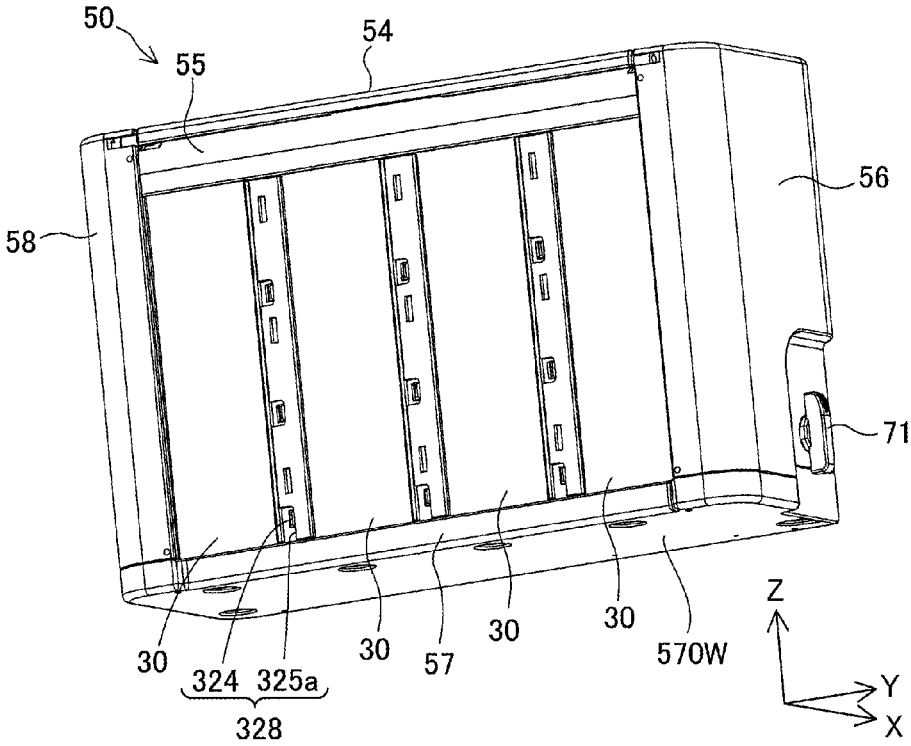
FIG. 4A is a first appearance perspective view of the container unit 50.
Figure 4B:
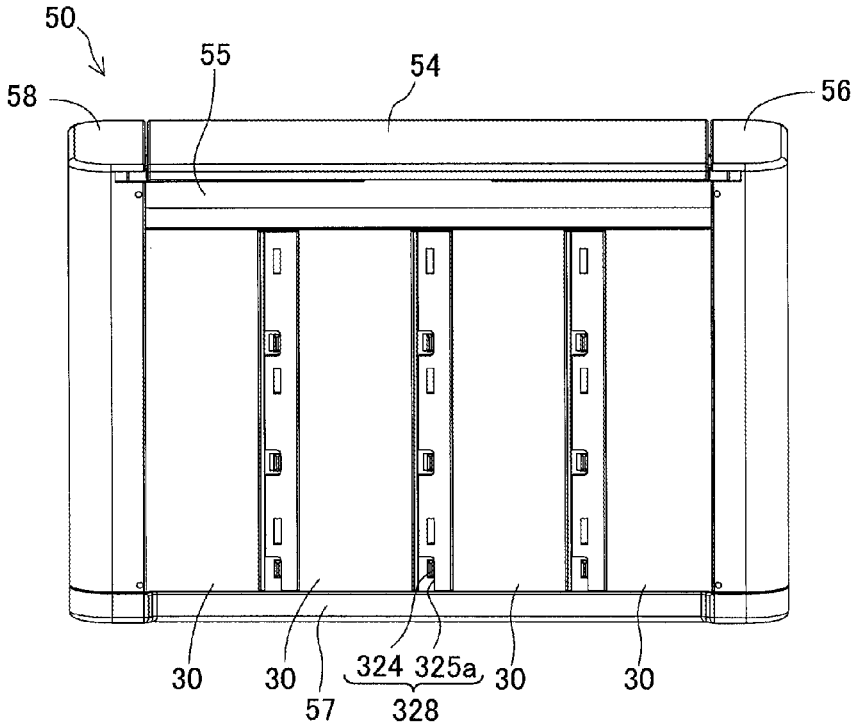
FIG. 4B is a second appearance perspective view of the container unit 50.

FIGS. 4A and 4B illustrate the general structure of the container unit 50. FIG. 4A is a first appearance perspective view of the container unit 50. FIG. 4B is a second appearance perspective view of the container unit 50. As shown in FIGS. 4A and 4B, the container unit 50 is formed in an approximate rectangular parallelepiped shape. The outer face of the bottom cover member 57 forms a bottom face 570W that comes into contact with the mounting surface in the liquid supply attitude of the container unit 50. Each of the four ink tanks 30 has positioning elements 328 including notches 325*a* and projections 324. The four ink tanks 30 are located and stacked with high accuracy by setting the projections 324 of one ink tank 30 in the notches 325*a* of an adjacent ink tank 30. The container unit 50 further includes a coupling cover member 55 for coupling the plurality of ink tanks 30 together. The coupling cover member 55 enables the plurality of ink tanks 30 to be integrated and unitized. Removing the coupling cover member 55 readily separates the plurality of unitized ink tanks 30. The number of ink tanks to be included in the container unit 50 is thus readily changeable according to the number and the specifications of the color inks used for the printer 12. The coupling cover member 55 will be described more in detail later.

Figure 5:
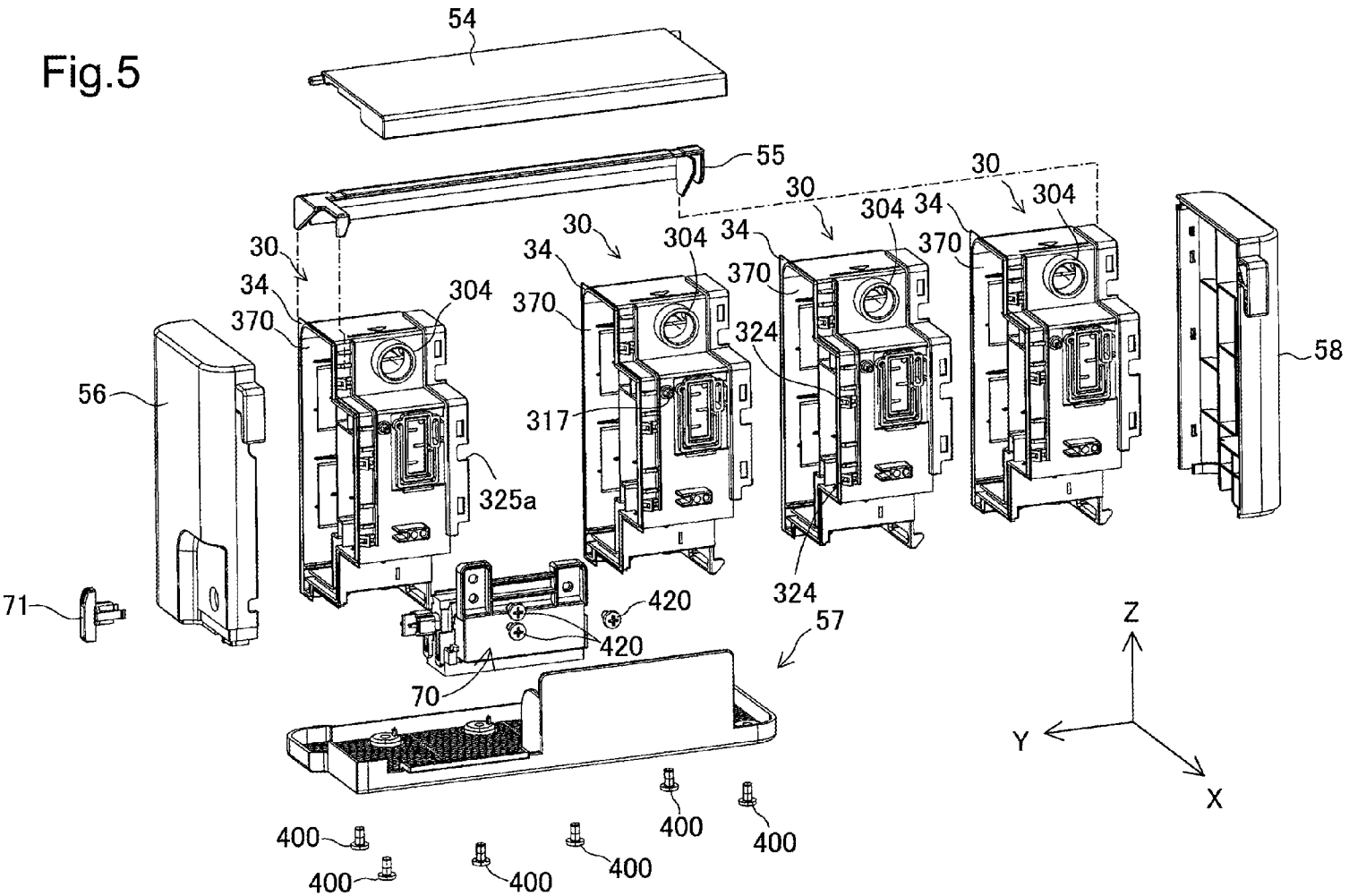
FIG. 5 is an exploded perspective view of the container unit 50.
Figure 6:
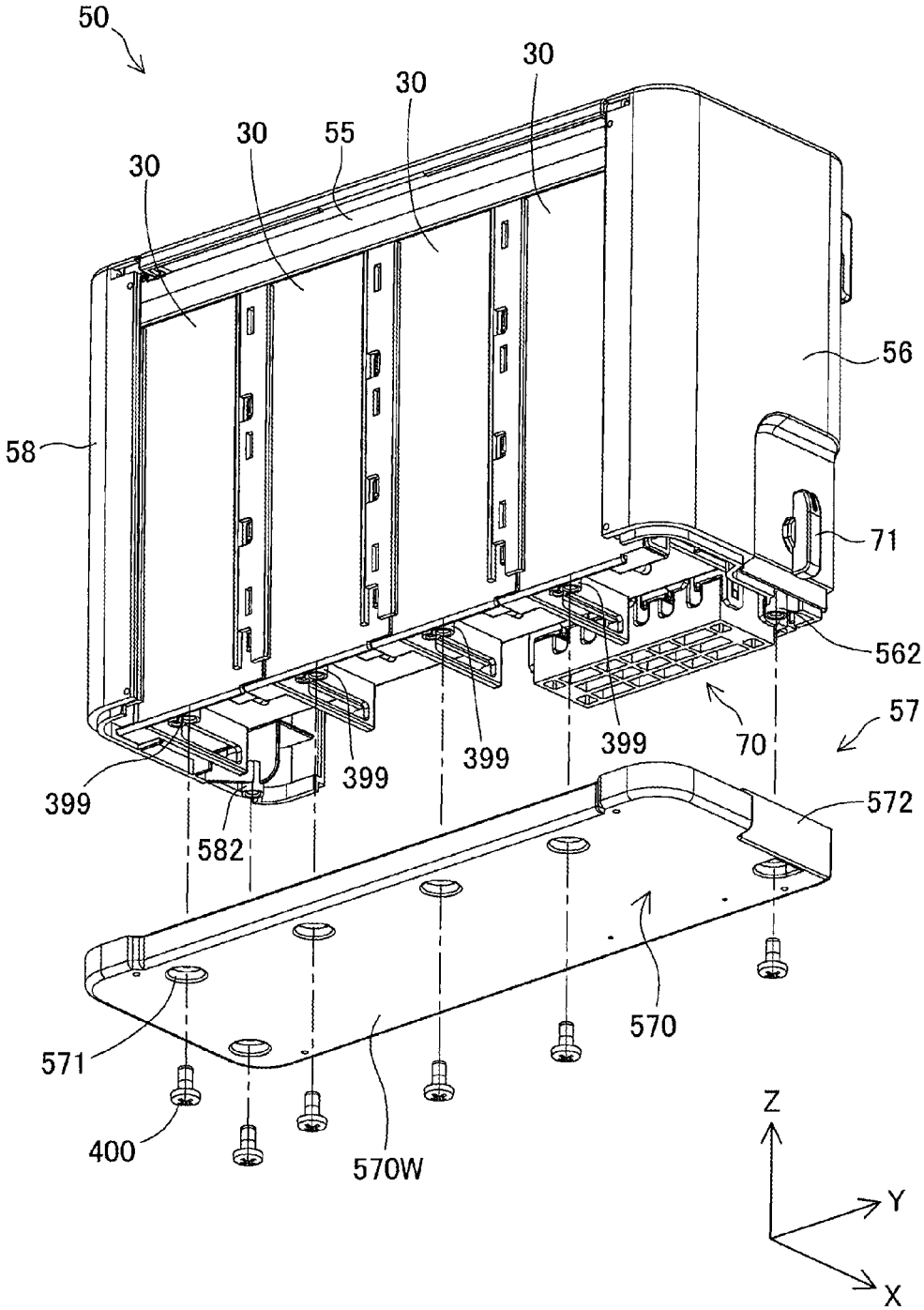
FIG. 6 is a perspective view of the container unit 50 after removal of a bottom cover member 57.

The structure of the container unit 50 is further described with reference to FIGS. 5 and 6. FIG. 5 is an exploded perspective view of the container unit 50. FIG. 6 is a perspective view of the container unit 50 after removal of the bottom cover member 57.

As shown in FIG. 5, the ink tank 30 is formed in a columnar shape. The plurality of ink tanks 30 are disposed and stacked in a line. The plurality of ink tanks 30 are disposed, such that an open wall member 370 of each ink tank 30 sealed with a film 34 that does not allow for permeation of a fluid is covered by an adjacent ink tank 30. The container unit 50 also has a valve unit 70 to open and close the inner flow path formed in the hose 23. The valve unit 70 is assembled as a component part to the container unit 50 with a plurality of screws 420. The detailed structure of the valve unit 70 will be described later.

As shown in FIG. 6, the bottom cover member 57 has a plurality of openings 571, through which a plurality of screws 400 are inserted. The plurality of screws 400 are inserted through the corresponding openings 571. The plurality of screws 400 are then screwed to a plurality of threaded holes 399, 562 and 582 formed in the ink tanks 30 and the side cover members 56 and 58, so that the bottom cover member 57 is assembled as a component part to the container unit 50. In other words, the openings 571 are used for assembling the bottom cover member 57 as the component part to the container unit 50. The bottom cover member 57 is also attached to cover the bottom faces of the plurality of (four) ink tanks 30 in the liquid supply attitude. According to this embodiment, the bottom cover member 57 is attached to the ink tanks 30 and the side cover members 56 and 58 with six screws 400. According to another embodiment, the openings 571 may be replaced with notches formed in the bottom cover member 57, and the screws 400 may be inserted into the notches.

A-3. Detailed Structure of Bottom Cover Member

Figure 7A:
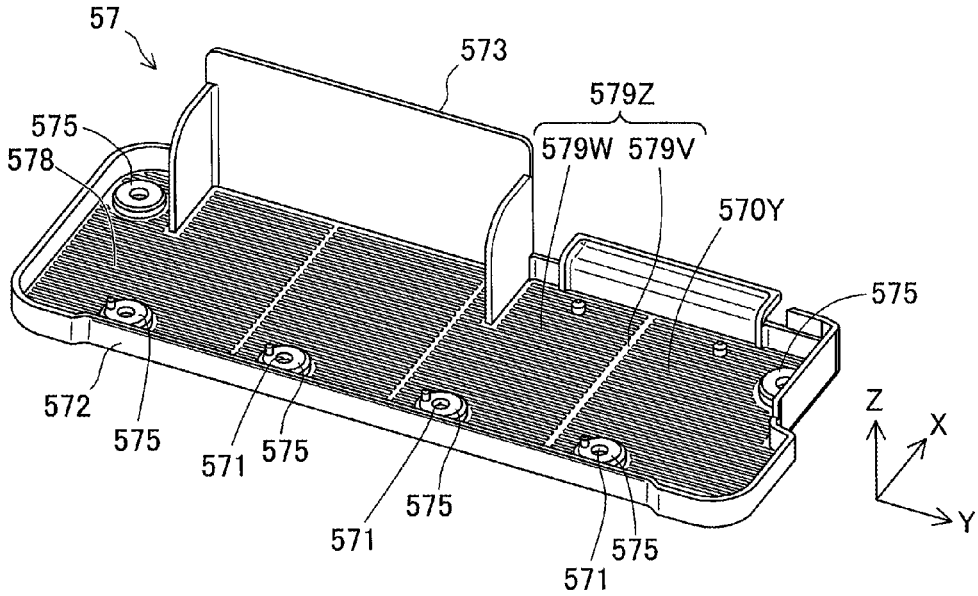
FIG. 7A is a perspective view of the bottom cover member 57.
Figure 7B:
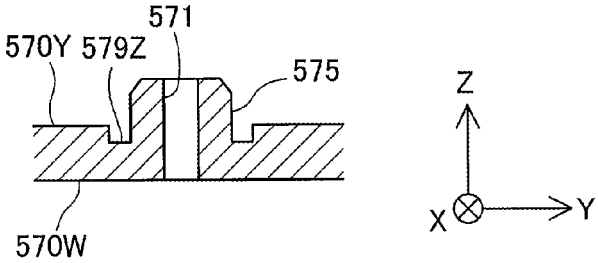
FIG. 7B is a partial sectional view showing circumferential rims 575 of the bottom cover member 57.
Figure 7C:
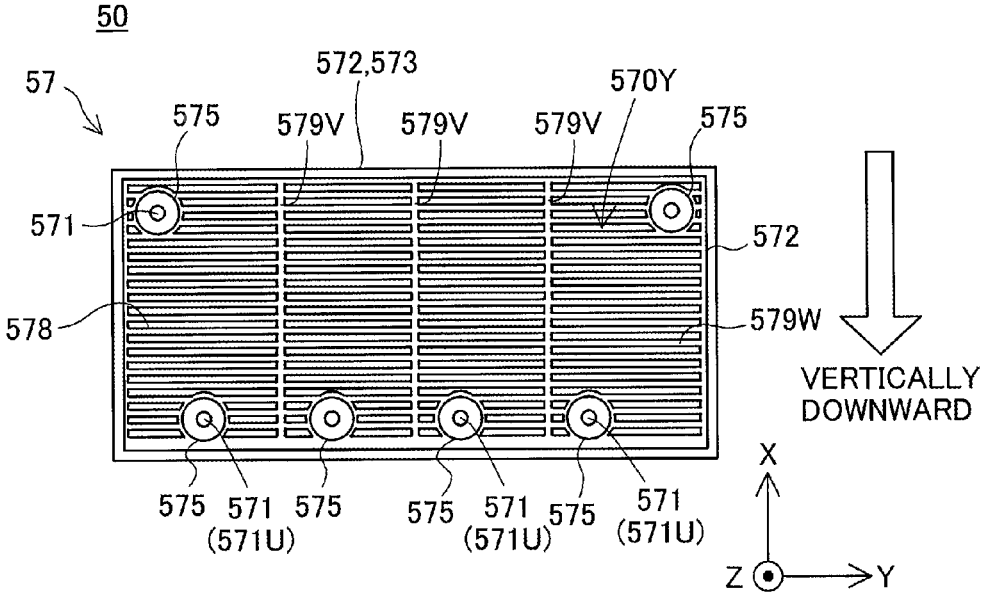
FIG. 7C is a diagram showing the detailed structure of an opposed face 570Y of the bottom cover member 57.

FIGS. 7A to 7C illustrate the detailed structure of the bottom cover member 57. FIG. 7A is a perspective view of the bottom cover member 57. FIG. 7B is a partial sectional view showing circumferential rims 575 of the bottom cover member 57. FIG. 7C is a diagram showing the detailed structure of an opposed face 570Y of the bottom cover member 57.

As shown in FIG. 7A, the bottom cover member 57 includes a flat-plate bottom cover base 578 and bottom cover walls 572 and 573 arranged to be vertically-angled relative to the bottom cover base 578. The bottom cover walls 572 and 573 are protruded from the periphery of the bottom cover base 578 toward the side on which the ink tanks 30 are mounted (i.e., Z-axis positive direction or upward direction of the bottom cover base 578). The plurality of ink tanks 30 are mounted on the bottom cover base 578. An oppose face 570Y of the bottom cover base 578 facing the ink tanks 30 has concaves or grooves 579Z serving as the liquid retainer. The concaves 579Z are formed throughout the opposed face 570Y. The concaves 579Z include a plurality of first concaves 579W and a plurality of second concaves 579V, which are disposed to cross each other.

The bottom cover member 57 further includes a plurality of (six in the embodiment) openings 571 formed to penetrate from the opposed face 570Y to a bottom face 570W and used to attach the bottom cover member 57 to the respective ink tanks 30. In other words, the plurality of openings 571 penetrate through the bottom cover base 578. The plurality of openings 571 are positioned in an arching line along the circumference of the bottom cover base 578.

The bottom cover member 57 further has a plurality of circumferential rims 575 provided on the opposed face 570Y to surround the respective openings 571. As illustrated in FIG. 7B, the circumferential rim 575 is an approximate columnar member protruded from the opposed face 570Y (more specifically, from the bottom of the concaves 579Z). The circumferential rims 575 are protruded to be higher than the opposed face 570Y in the liquid supply attitude. Each of the openings 571 is formed to be located inside each of the circumferential rims 575.

As shown in FIG. 7C, in the liquid receiving attitude of the container unit 50, the X-axis direction corresponds to the vertical direction, and the X-axis negative direction corresponds to the vertically downward direction. In the liquid receiving attitude, the bottom cover member 57 is vertically-angled relative to the mounting surface of the container unit 50. According to this embodiment, the bottom cover base 578 of the bottom cover member 57 is arranged to be substantially perpendicular to the mounting surface in the liquid receiving attitude. The first concaves 579W are grooves extended in the horizontal direction (i.e., Y-axis direction or first direction) in the liquid receiving attitude. More specifically, the plurality of first concaves 579W are extended throughout the longitudinal direction (i.e., Y-axis direction or length direction) of the bottom cover base 578, while being formed at fixed intervals throughout the shorter-side direction (i.e., X-axis direction or width direction) of the bottom cover base 578. In the liquid receiving attitude, at least one of the plurality of first concaves 579W is disposed vertically above lower openings 571U, which are located on the vertically lower side among the plurality of openings 571 in the liquid receiving attitude. The size of the first concaves 579W is not specifically limited but may be dimensions for sufficiently retaining ink by capillarity.

The second concaves 579V are grooves extended in the vertical direction (i.e., X-axis direction or second direction) in the liquid receiving attitude. More specifically, the second concaves 579V are formed near the boundaries between respective adjacent ink tanks 30 on the opposed face 570Y. The plurality of second concaves 579V are extended throughout the shorter-side direction (i.e., X-axis direction or width direction) of the bottom cover base 578. In other words, the respective second concaves 579V are formed linearly continuously across the area of the first concaves 579W in the vertical direction (X-axis direction or second direction) in the liquid receiving attitude. The first concaves 579W and the second concaves 579V are disposed orthogonal to each other to form a lattice-like pattern as a whole. The size of the second concaves 579V is not specifically limited but may be dimensions for sufficiently retaining ink by capillarity.

There is a possibility that ink is present (flows in) the opposed face 570Y of the bottom cover member 57 due to various reasons. For example, the user may accidentally fall drops of ink at a position other than the liquid fill port 304 during pouring ink into the ink tank 30. In this case, when the attitude of the container unit 50 with ink adhering to the surface of the ink tank 30 is changed from the liquid receiving attitude to the liquid supply attitude, the adhering ink may flow into the bottom cover member 57 by gravity. There is also a possibility that some failure or flaw of the ink tank 30 causes leakage of ink outside the ink tank 30 during ink supply. In this case, the leaking ink may flow down the surface of the ink tank 30 into the bottom cover member 57.

As described above, according to this embodiment, the bottom cover member 57 has the concaves 579Z on the opposed face 570Y (FIGS. 7A and 7C). Even when ink is present on the bottom cover member 57, the concaves 579Z can retain the ink. This decreases the possibility that ink flows out of the container unit 50 and thereby reduces the possibility that the mounting surface of the container unit 50 (for example, desktop) is stained with ink.

The concaves 579Z include the first concaves 579W extended in the horizontal direction in the liquid receiving attitude (FIGS. 7A and 7C). Even when ink is present on the opposed face 570Y of the bottom cover member 57, The first concaves 579W prevent the ink from moving vertically downward in the liquid receiving attitude. This decreases the possibility that ink flows out of the container unit 50 in the liquid receiving attitude.

The concaves 579Z also include the second concaves 579V extended in the vertical direction in the liquid receiving attitude to be orthogonal to the first concaves 579W (FIGS. 7A and 7C). Even when ink is present on the bottom cover member 57, the second concaves 579V prevent ink from retaining in a specific portion of the concaves 579Z. This arrangement of the plurality of first concaves 579W and the plurality of second concaves 579V ensures smooth diffusion of ink that is present in a specific area of the concaves 579Z. Such diffusion increases the surface area of ink retained in the concaves 579Z and accelerates vaporization of ink. This further decreases the possibility that ink flows out of the container unit 50.

The bottom cover member 57 has the circumferential rims 575 provided on the opposed face 570Y side to be protruded to be higher than the opposed face 570Y in the liquid supply attitude and surround the respective openings 571 (FIGS. 7A and 7B). Even when ink is present on the opposed face 570Y, the circumferential rims 575 serve as the barriers, so as to reduce the possibility that ink flows into the openings 571. This further decreases the possibility that ink flows out of the bottom cover member 57.

The bottom cover member 57 has the bottom cover walls 572 and 573 protruded from the periphery of the bottom cover base 578 toward the side on which the ink tanks 30 are mounted (FIGS. 7A and 7C). Even when a large amount of ink that cannot be retained by the concaves 579Z is present on the opposed face 570Y, the bottom cover walls 572 and 573 serve as the barriers, so as to decrease the possibility that ink flows out of the bottom cover member 57. In other words, the bottom cover walls 572 and 573 block the flow of ink toward outside of the bottom cover member 57.

A-4. Detailed Structure of Other Component Parts of Container Unit

Figure 8B:
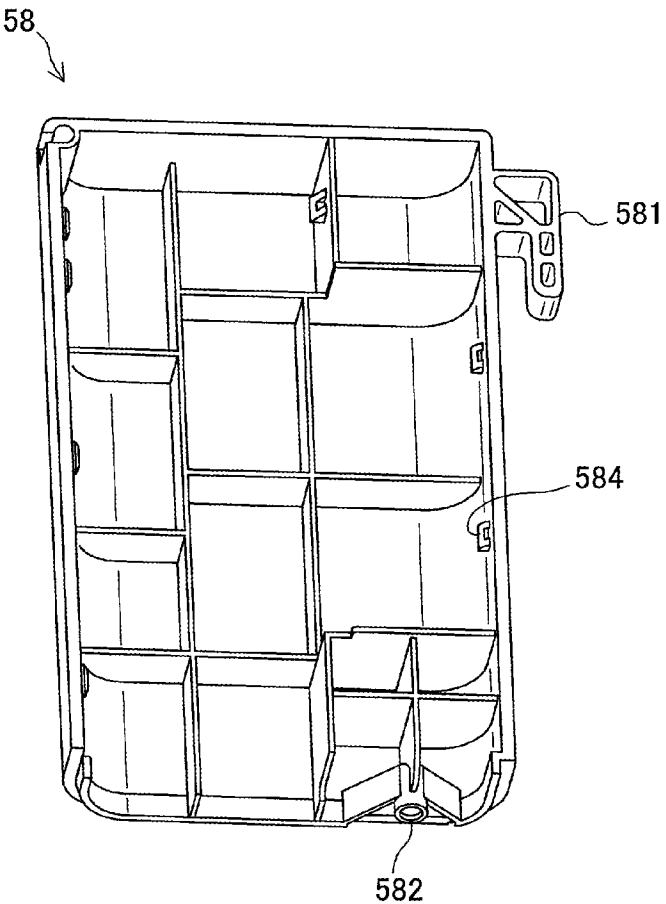
FIG. 8B is an appearance perspective view of the second side cover member 58.
Figure 8A:
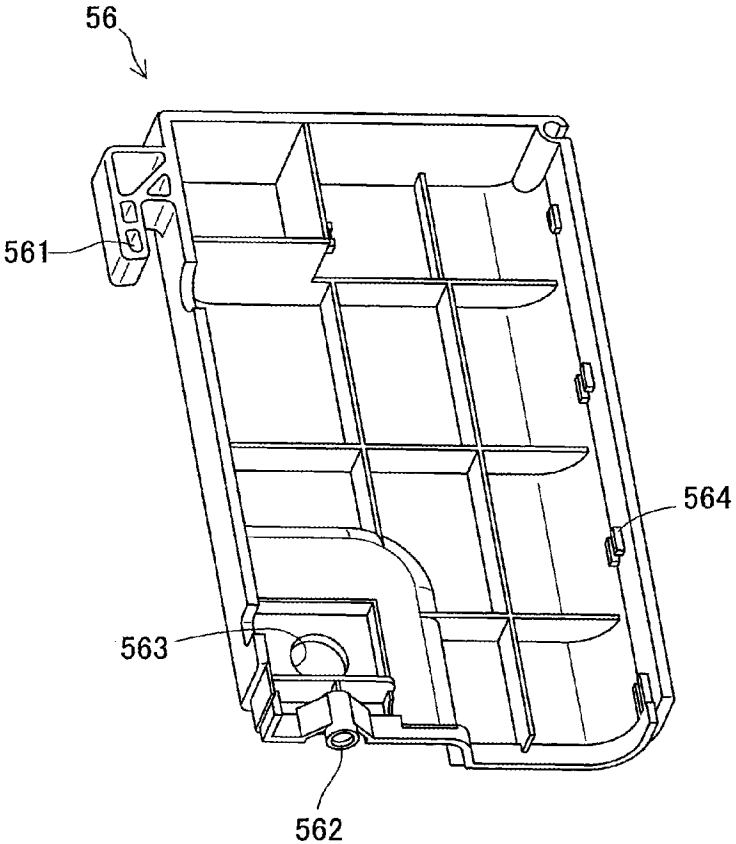
FIG. 8A is an appearance perspective view of the first side cover member 56.

The other component parts of the container unit 50 are described below. FIGS. 8A and 8B illustrate the first side cover member 56 and the second side cover member 58. FIG. 8A is an appearance perspective view of the first side cover member 56. FIG. 8B is an appearance perspective view of the second side cover member 58.

As illustrated in FIG. 8A, the first side cover member 56 has a catch 561 to make the container unit 50 caught in the fixation member 120 of the printer 12 (FIG. 3B). The first side cover member 56 also has a through hole 563, which the handle 71 (FIG. 6) passes through, and a screw hole 562 for fixing the bottom cover member 57 with the screw 400 (FIG. 5). Fitting elements 564 are formed on the inner surface of the first side cover member 56 opposed to the ink tank 30 to receive the projections 324 of the ink tank 30 (FIG. 4B).

As shown in FIG. 8B, the second side cover member 58 has a catch 581 to make the container unit 50 caught in the fixation member 120 of the printer 12 (FIG. 3B). The second side cover member 58 also has a screw hole 582 for fixing the bottom cover member 57 with the screw 400 (FIG. 5). Projections 584 are formed on the inner surface of the second side cover member 58 opposed to the ink tank 30 to be fit in the notches 325*a* of the ink tank 30 (FIG. 4B).

Figure 9A:
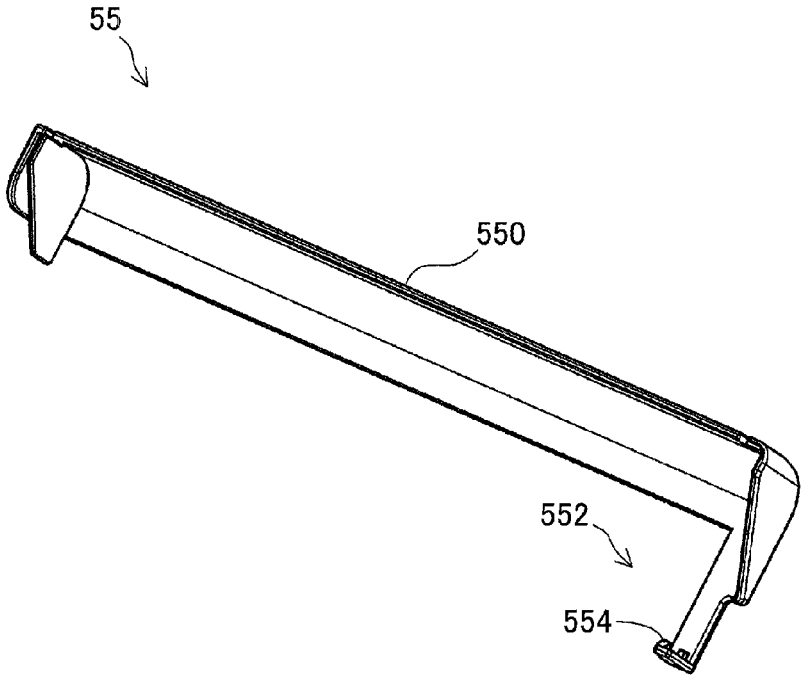
FIG. 9A is an appearance perspective view of the coupling cover member 55.
Figure 9B:
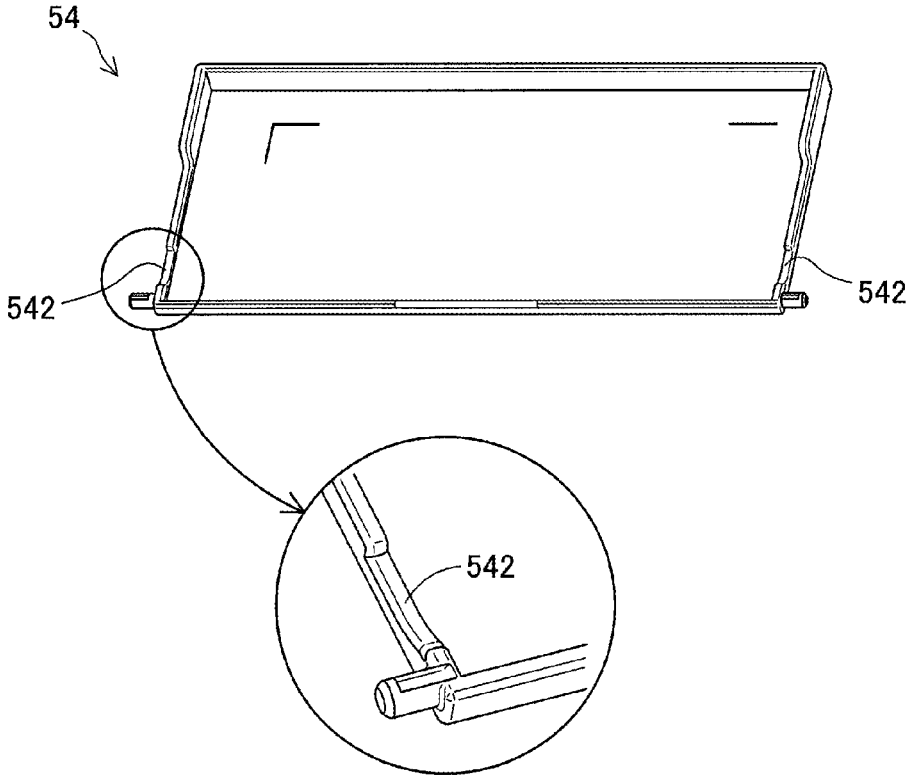
FIG. 9B is an appearance perspective view of the upper cover member 54.

FIGS. 9A and 9B illustrate the coupling cover member 55 and the upper cover member 54. FIG. 9A is an appearance perspective view of the coupling cover member 55. FIG. 9B is an appearance perspective view of the upper cover member 54.

The coupling cover member 55 prevents the adjacent ink tanks 30, which are readily stacked by means of the positioning elements 328, from being separated. The coupling cover member 55 is placed across the plurality of ink tanks 30 of the container unit 50. As shown in FIG. 9A, one end of the coupling cover member 55 has a fixation member 552 to be secured to the ink tank 30. A clutch 554 on an edge of the fixation member 552 is caught on the end ink tank 30 located at the end of the plurality of ink tanks 30. The coupling cover member 55 is placed between the ink tanks 30 and the cover members 54, 56 and 58 (more specifically, upper cover member 54, first side cover member 56 and second side cover member 58).

As illustrated in FIG. 9B, the upper cover member 54 has recesses 542 provided on both ends to receive the coupling cover member 55.

Figure 10:
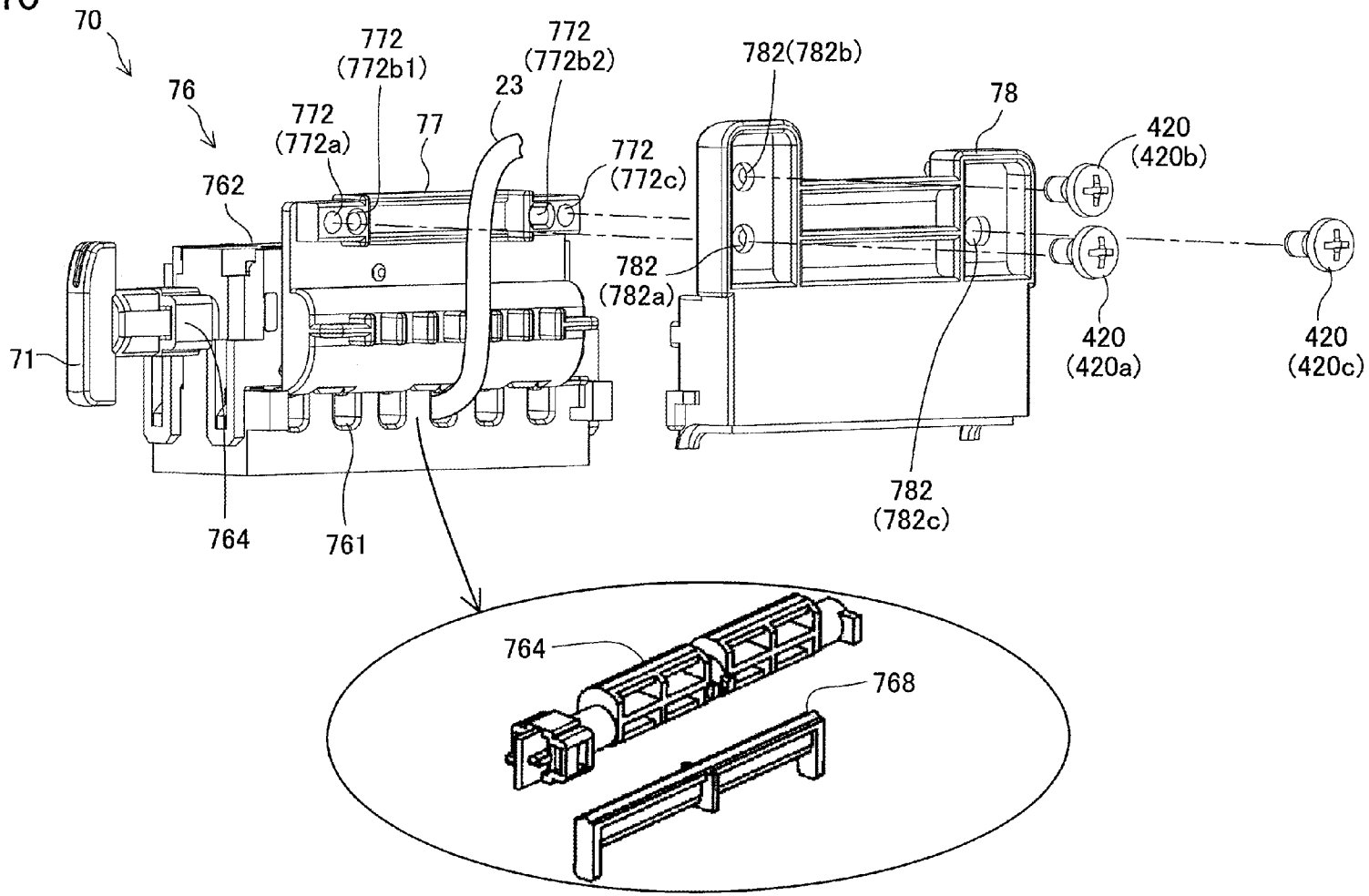
FIG. 10 is an exploded perspective view of a valve unit 70.
Figure 11A:
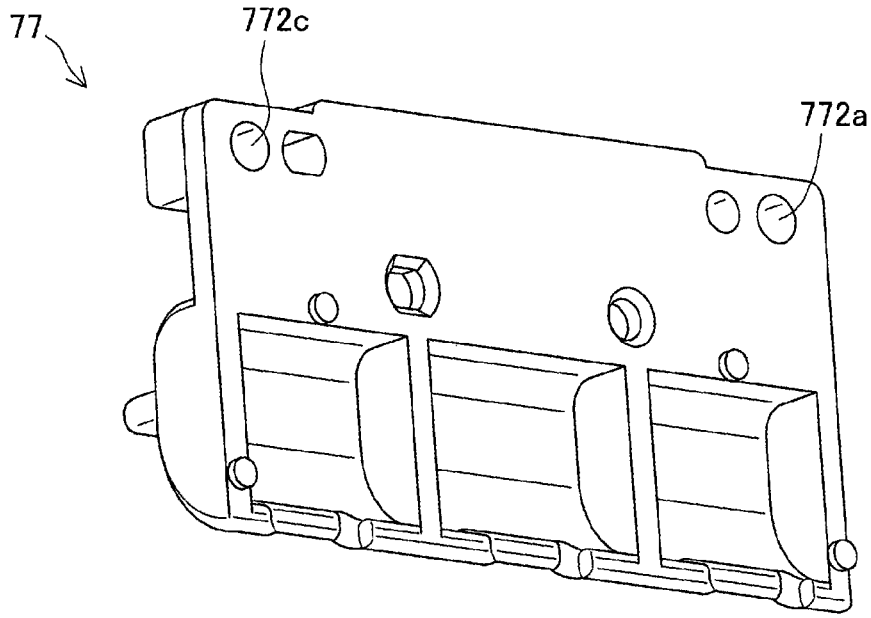
FIG. 11A is an appearance perspective view of the first member 77.
Figure 11B:
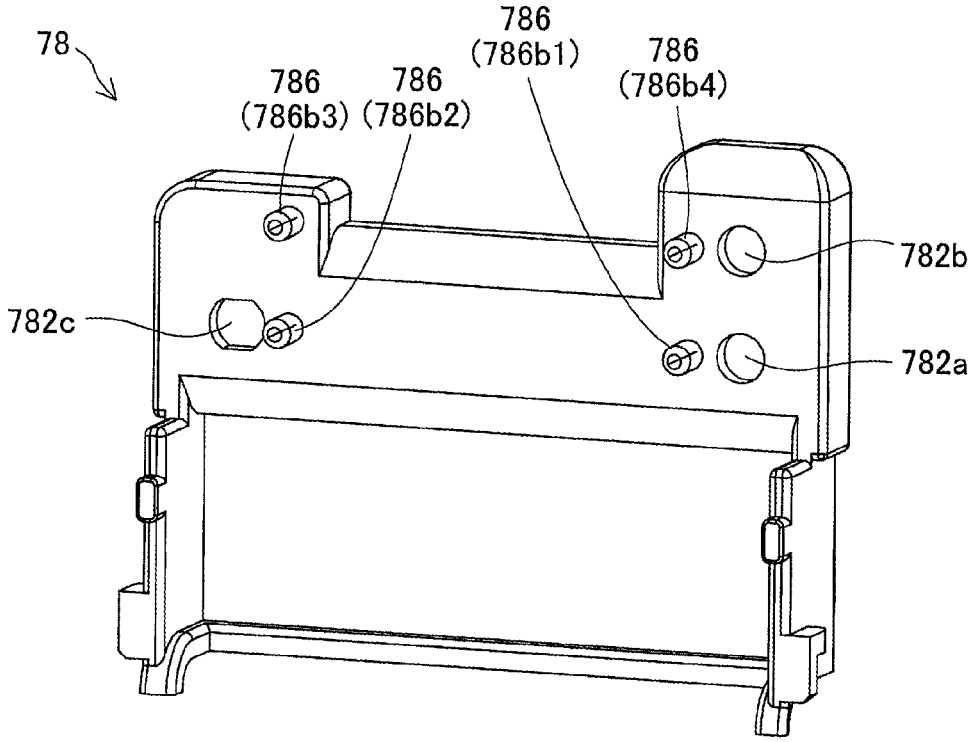
FIG. 11B is an appearance perspective view of the second member 78.
Figure 12A:
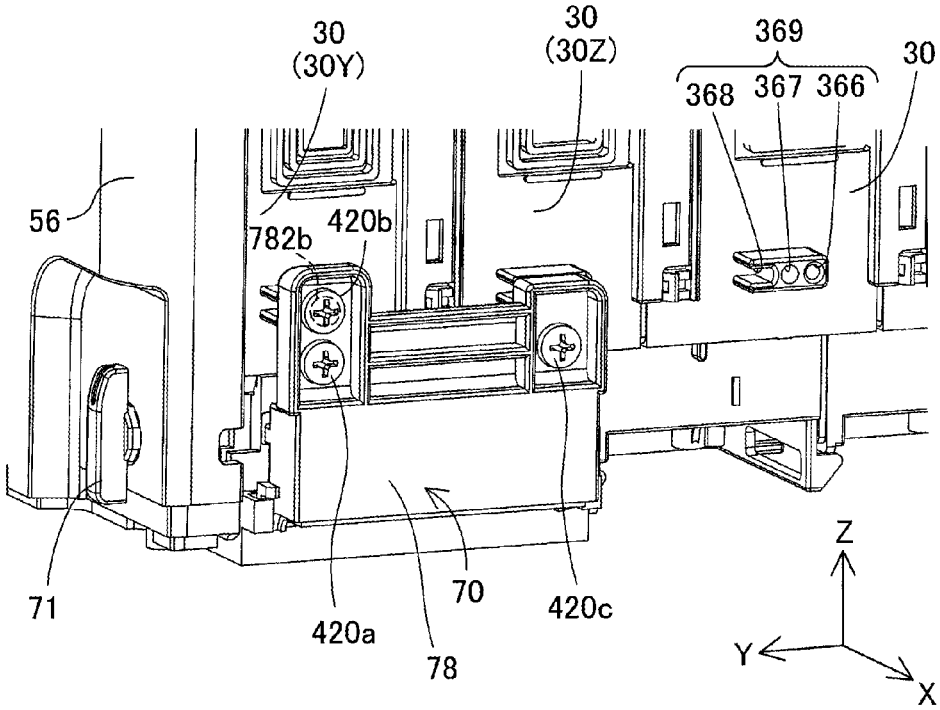
FIG. 12A is an appearance perspective view illustrating the valve unit 70 attached to the ink tank 30.
Figure 12B:
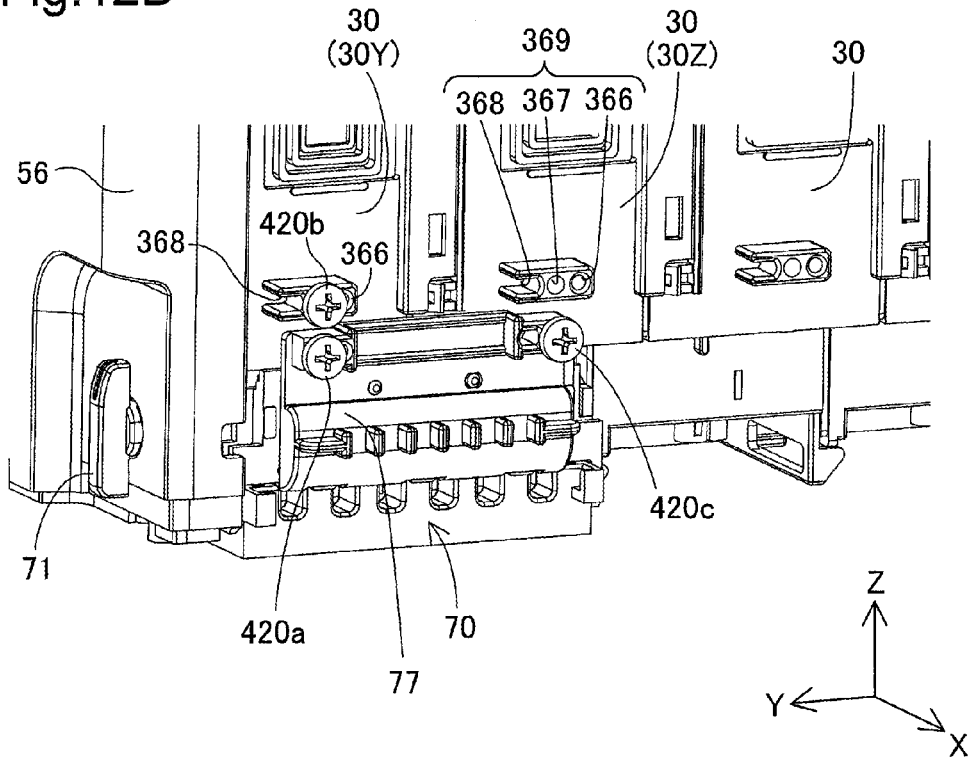
FIG. 12B illustrates the valve unit 70 of FIG. 12A without the second member 78.

The valve unit 70 is described below with reference to FIGS. 10 to 12. FIG. 10 is an exploded perspective view of the valve unit 70. FIGS. 11A and 11B illustrate a first member 77 and a second member 78. FIG. 11A is an appearance perspective view of the first member 77. FIG. 11B is an appearance perspective view of the second member 78. FIGS. 12A and 12B illustrate attachment of the valve unit 70 to the ink tank 30. FIG. 12A is an appearance perspective view illustrating the valve unit 70 attached to the ink tank 30. FIG. 12B illustrates the valve unit 70 of FIG. 12A without the second member 78. For the better understanding of illustration, only one of the four houses 23 is set in the valve unit 70 in FIG. 10. The internal structure of a switching assembly 76 is illustrated in an encircled area in FIG. 10. Illustration of the hoses 23 is omitted from FIGS. 12A and 12B.

As illustrated in FIG. 10, the valve unit 70 has the handle 71, the switching assembly 76, the first member 77 and the second member 78. The switching assembly 76 includes a casing body 762, a cam 764 having one end portion coupled to the handle 71, and a slider 768. The one end portion of the cam 764 is exposed on the outside of the casing body 762, whilst the remaining portion of the cam 764 is placed inside the casing body 762. The slider 768 is placed inside the casing body 762. The slider 768 is displaced in conjunction with the rotation of the cam 764 to squeeze a portion of the hose 23, which passes through inside of the casing body 762. In other words, the flow path of the hose 23 is opened and closed by displacing the slider 768.

The hose 23 passes through an opening 761 of the casing body 762 and is connected to the printer 12. The first member 77 and the second member 78 securely hold part of the hose 23 passing through the opening 761 and being placed therebetween. The first member 77 and the second member 78 respectively have a plurality of openings 772 and a plurality of openings 782 used for attachment of the first member 77 and the second member 78 to a specific member. The first member 77 and the second member 78 are assembled as the component parts to the container unit 50 with the plurality of screws 420 inserted through the plurality of openings 772 and 782. The plurality of openings 772 and 782 may be expressed by symbols in parentheses for the purpose of distinction. The plurality of screws 420 may be expressed by symbols in parentheses for the purpose of distinction.

As illustrated in FIG. 11B, a plurality of projections 786 are formed on one face of the second member 78 opposed to the first member 77. The plurality of projections 786 may respectively be expressed by symbols in parentheses for the purpose of distinction.

As illustrated in FIG. 10, the first member 77 and the second member 78 are assembled with the hose 23 placed therebetween. More specifically, the openings 782*a* and 772*a* are aligned and the screw 420*a* is inserted through the openings 782*a* and 772*a*, whilst the openings 782*c* and 772*c* are aligned and the screw 420*c* is inserted through the openings 782*c* and 772*c*. The projections 786*b*1 and 786*b*2 shown in FIG. 11B are respectively inserted through the openings 772*b*1 and 772*b*2 of the first member 77. Such insertions integrate the first member 77 with the second member 78.

As illustrated in FIG. 12A, the integrated first and second members 77 and 78 are attached to multiple (two) ink tanks 30. More specifically, the first and second members 77 and 78 are attached to the two adjacent ink tanks 30, such that the two ink tanks 30 are readily separable from each other while the first and second members 77 and 78 are kept attached to the two ink tanks 30. Such attachment of the first and second members 77 and 78 to the ink tanks 30 is described more in detail. For the convenience of explanation, one of the two ink tanks 30, to which the first and second members 77 and 78 are attached, is called "ink tank 30Y", and the other is called "ink tank 30Z".

The ink tank 30 has a member attachment structure 369 on its outer surface for attachment of the first and second members 77 and 78. The member attachment structure 369 has an approximate rectangular parallelepiped projection formed on the surface of the ink tank 30. The member attachment structure 369 has first to third attachment holes 366, 367 and 368. The first attachment hole 366 and the second attachment hole 367 are open to a first side opposed to the second member 78. The third attachment hole 368 is open to both the first side opposed to the second member 78 and a second side (Y-axis positive direction side). In the example of the member attachment structure 369 of the ink tank 30Z, the second side is along the alignment direction of the ink tanks 30 (Y-axis direction) and faces the other ink tank 30Y with the valve unit 70. According to this embodiment, the third attachment hole 368 is formed in a U shape.

As illustrated in FIGS. 12A and 12B, the screw 420*b* passes through the opening 782*b* of the second member 78 and the second attachment hole 367 of the ink tank 30Y to screw the second member 78 to the ink tank 30Y. The projection 786*b*4 of the second member 78 (FIG. 11B) is inserted through the second attachment hole 367 of the ink tank 30Y, whilst the projection 786*b*3 of the second member 78 (FIG. 11B) is inserted through the third attachment hole 368 of the adjacent ink tank 30Z. The second member 78 of the valve unit 70 is accordingly screwed to only one ink tank 30Y of the two ink tanks 30Y and 30Z. The two ink tanks 30Y and 30Z can thus be readily separated from each other without removing the screw 420*b* for securing the valve unit 70 to the ink tank 30Y.

A-5. General Structure of Ink Tank

Figure 13:
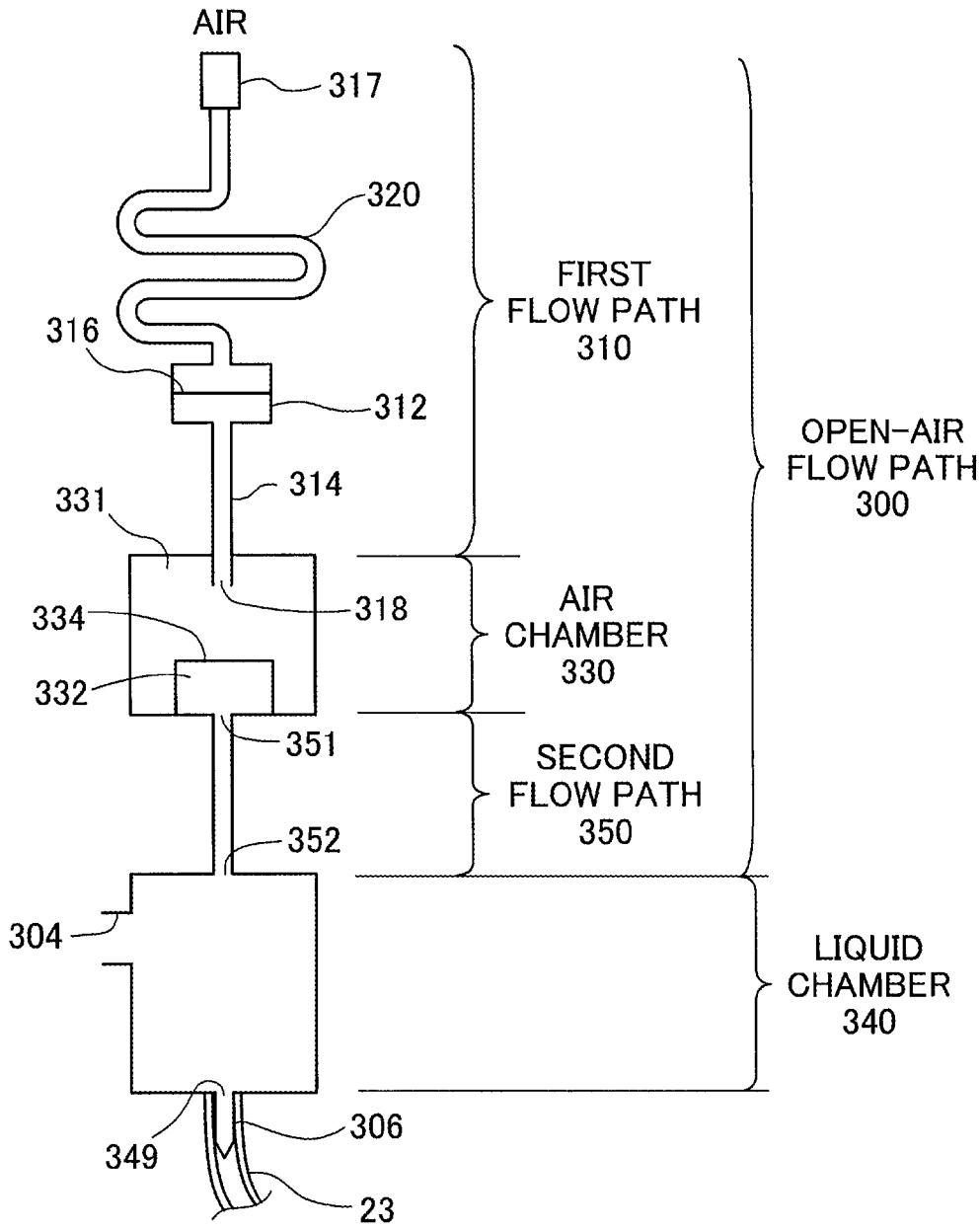
FIG. 13 is a conceptual view showing the pathway from an air inlet 317 to a liquid discharge port 306.

For the better understanding, prior to description of the detailed structure of the ink tank 30, the pathway (flow path) from the air inlet 317 open to the outside, to the liquid discharge port 306 for discharging ink out is conceptually described with reference to FIG. 13. FIG. 13 conceptually illustrates the pathway from the air inlet 317 to the liquid discharge port 306. The pathway from the air inlet 317 to the liquid discharge port 306 is also called "flow path".

The pathway from the air inlet 317 to the liquid discharge port 306 is roughly divided into an open-air flow path 300 and a liquid chamber 340. The open-air flow path 300 includes a first flow path 310 (also called "air connection path 310"), an air chamber 330 and a second flow path 350 (also called "liquid connection path 350") sequentially arranged from upstream to downstream.

The first flow path 310 has the air chamber opening 318 at one end open to the air chamber 330 and the air inlet 317 at the other end open to the outside, so as to connect the air chamber 330 to the outside. The first flow path 310 includes a connecting flow path 320, a gas-liquid separation chamber 312 and a connecting flow path 314. The connecting flow path 320 has one end connecting with the air inlet 317 and the other end connecting with the gas-liquid separation chamber 312. Part of the connecting flow path 320 forms an elongated flow path to prevent the moisture of ink accumulated in the liquid chamber 340 from diffusing and evaporating from the open-air flow path 300. A film or sheet member 316 is disposed between the upstream portion and the downstream portion of the gas-liquid separation chamber 312. This film 316 has gas permeability and liquid impermeability. Providing this film 316 in the midst of the open-air flow path 300 prevents the backflow of ink from the liquid chamber 340 from flowing into the upstream of the film 316. The film 316 wetted with ink may impair its original function as the gas-liquid separation membrane and may not allow for permeation of the air.

The connecting flow path 314 connects the gas-liquid separation chamber 312 with the air chamber 330. One end of the connecting flow path 314 forms the air chamber opening 318.

The air chamber 330 contains the air. The air chamber 330 has the larger flow path cross-sectional area than the second flow path 350 (described later) and has a preset volume. This structure temporarily accumulates the back flow of ink from the liquid chamber 340 and prevents the ink from flowing into the upstream of the air chamber 330.

The air chamber 330 has a partition wall 334 provided as a restrictor in the middle of the pathway (flow path) from the second flow path 350 to the air chamber opening 318. The partition wall 334 divides the air chamber 330 into an opening-side chamber 331 with the air chamber opening 318 and a connecting flow path-side chamber 332 with an one-end opening 351. The connecting flow path-side chamber 332 is located between the opening-side chamber 331 and the second flow path 350.

The second flow path 350 has one-end opening 351 at one end located inside the air chamber 330 and other-end opening 352 at the other end located inside the liquid chamber 340, so that the second flow path 350 connects the air chamber 330 with the liquid chamber 340. The second flow path 350 has the sufficiently small flow path cross-sectional area to form the meniscus (liquid bridging).

The liquid chamber 340 contains ink and is designed to supply ink through a liquid outlet 349 of the liquid discharge port 306 into the sub-tank 20 (FIG. 1) via the hose 23. The liquid chamber 340 also has the liquid fill port 304 as explained above.

A-6. Detailed Structure of Ink Tank

Figure 14:
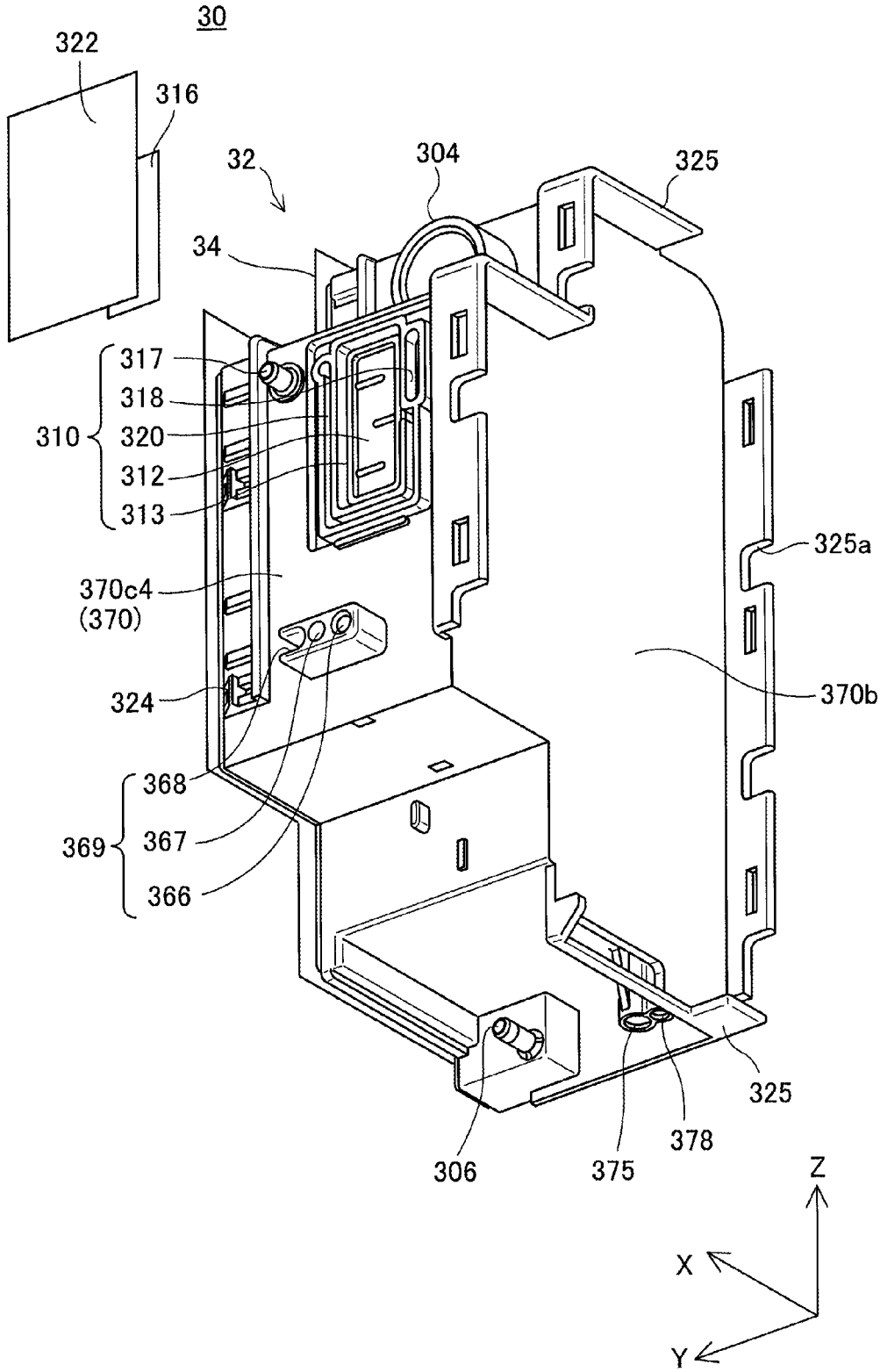
FIG. 14 is a first appearance perspective view of the ink tank 30.
Figure 15:
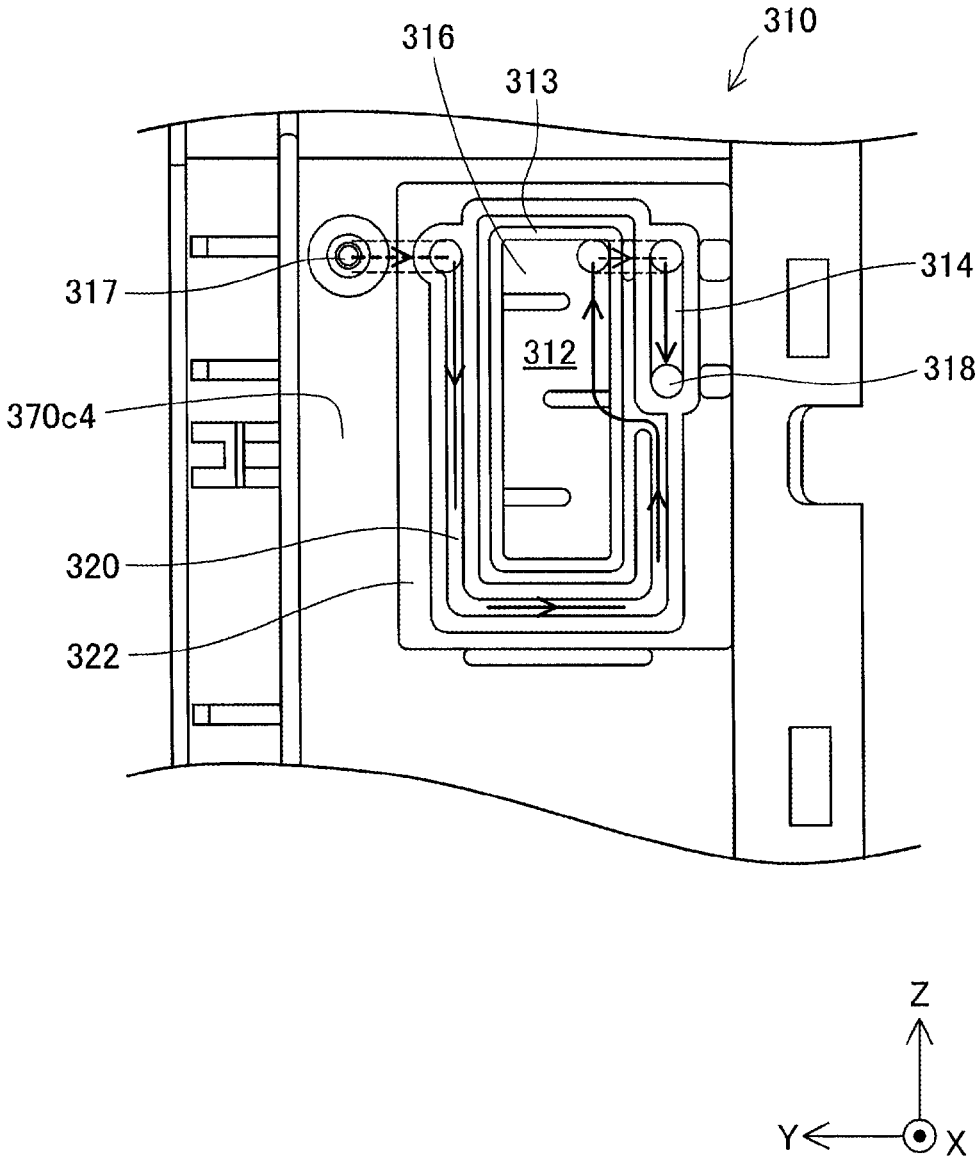
FIG. 15 illustrates a first flow path 310.
Figure 16:
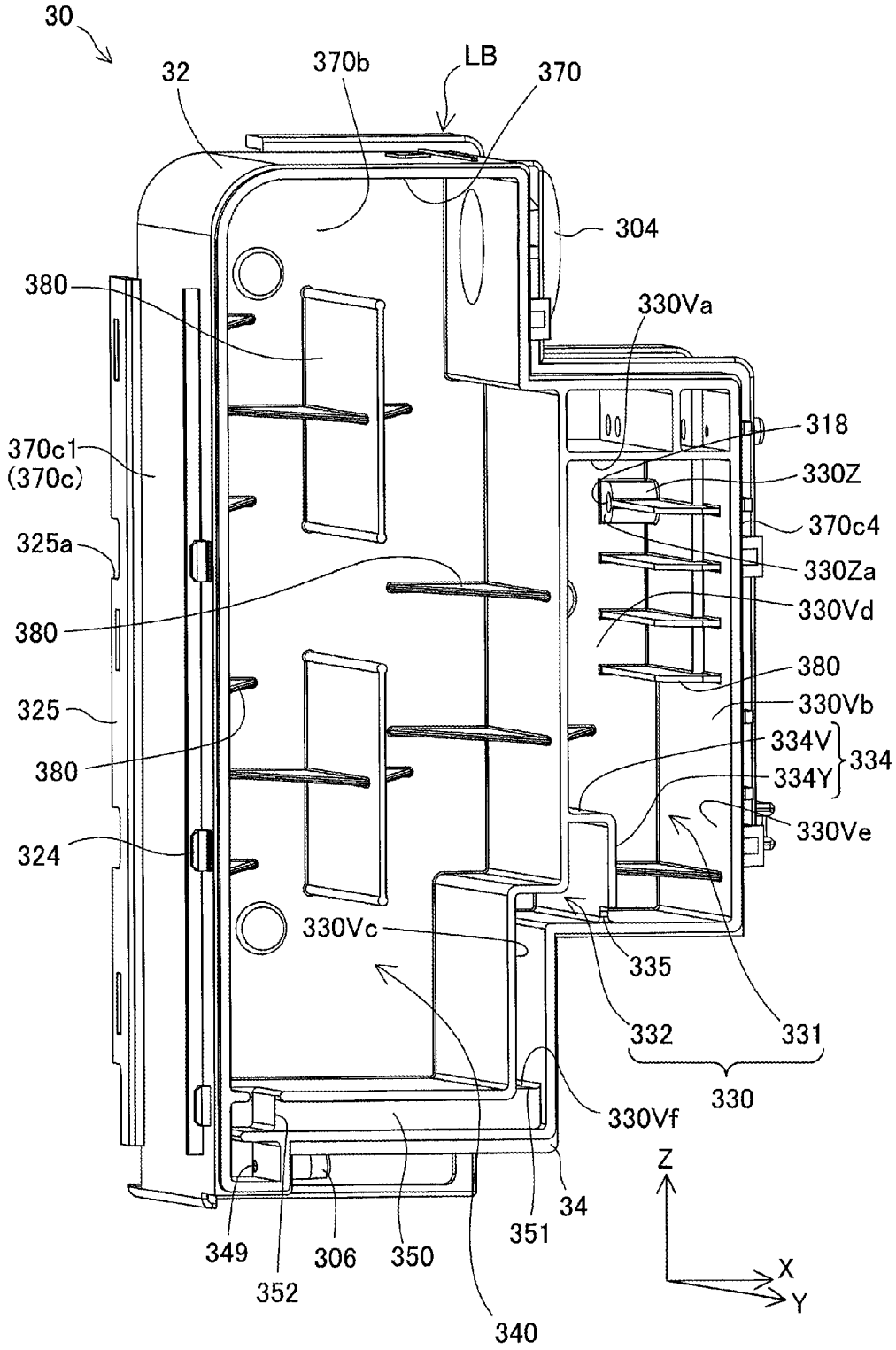
FIG. 16 is a second appearance perspective view of the ink tank 30.
Figure 17:
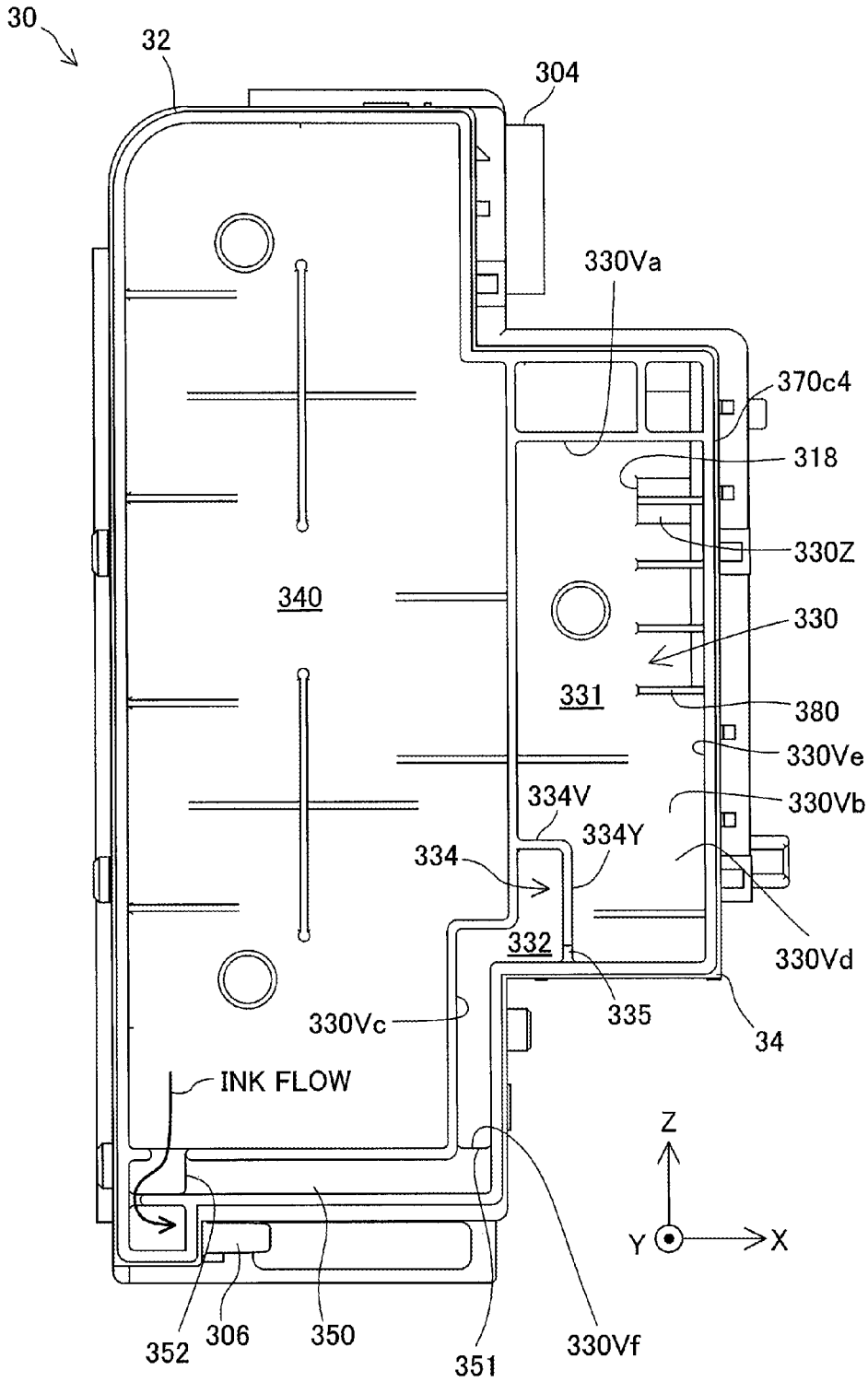
FIG. 17 is a view of the ink tank 30 of FIG. 16, seen from the Y-axis positive direction.

The detailed structure of the ink tank 30 is described below with reference to FIGS. 14 to 17. FIG. 14 is a first appearance perspective view of the ink tank 30. FIG. 15 illustrates the first flow path 310. FIG. 16 is a second appearance perspective view of the ink tank 30. FIG. 17 is a view of the ink tank 30, seen from the Y-axis positive direction. In FIG. 14, films 316 and 322 included in the ink tank 30 are separate from a tank body 32. Illustration of the plug member 302 placed in the liquid fill port 304 is omitted from FIGS. 14, 16 and 17. The arrows in FIG. 15 show the air flow from the air inlet 317 to the air chamber opening 318.

As illustrated in FIGS. 14, 16 and 17, the ink tank 30 is formed in an approximate columnar shape (more specifically, approximate rectangular columnar shape). Referring to FIG. 14, the ink tank 30 includes the tank body 32 and the films 34, 316 and 322. The tank body 32 is made of a synthetic resin, such as polypropylene and is translucent to allow the user to visually check the state of ink (i.e., ink level) inside the tank body 32 from the outside.

As shown in FIG. 16, the tank body 32 is formed in a concave shape including one side face with opening. Ribs (wall members) 380 in various shapes are provided in the concave of the tank body 32. The one side face with opening (i.e., one side face including the outer frame of the tank body 32 to form the opening) is called open wall member 370 (or open side face 370). A wall member opposed to the open wall member 370 as shown in FIG. 14 is called opposed wall member 370*b*. Side faces connecting the respective sides of the open wall member 370 and the opposed wall member 370*b* are called side wall members 370*c*. Different side wall members 370*c* that are not located on the same plane may be expressed by different symbols for the purpose of distinction.

As shown in FIG. 16, the film 34 is bonded to the tank body 32 to cover the opening of the open wall member 370 by, for example, thermal adhesion. More specifically, the film 34 is closely and tightly bonded to the end faces of the ribs 380 and to the end face of the outer frame of the tank body 32, so as to define a plurality of chambers, i.e., the air chamber 330, the liquid chamber 340 and the second flow path 350. In other words, the tank body 32 and the film 34 form the air chamber 330, the liquid chamber 340 and the second flow path 350.

Prior to description of the chambers 330, 340 and 350, the detailed structure of the first flow path 310 is described with reference to FIG. 15. As shown in FIG. 15, the first flow path 310 is formed on the side wall member 370*c*4 (also called "opposed side wall member 370*c*4"). The side wall member 370*c*4 is the wall member opposed to the printer 12 in the liquid supply attitude. The upstream section of the connecting flow path 320 is formed on the back side of the side wall member 370*c*4 (i.e., inside the tank body 32).

The gas-liquid separation chamber 312 is formed in a concave shape with opening in the bottom face of the concave. The gas-liquid separation chamber 312 communicates with the connecting flow path 314 via the opening in the bottom face. One end of the connecting flow path 314 forms the air chamber opening 318.

A convex 313 is formed along the entire circumference of the inner wall surrounding the bottom face of the gas-liquid separation chamber 312. The film 314 (FIG. 14) is bonded to the convex 313. The film 322 is also bonded to the side wall member 370*c*4 to cover a specific flow path portion of the first flow path 310 formed on the outer surface of the side wall member 370*c*4. This forms the connecting flow path 320 and prevents the ink contained in the ink tank 30 from leaking out. Part of the connecting flow path 320 is formed along the outer circumference of the gas-liquid separation chamber 312 to extend the distance from the air inlet 317 to the gas-liquid separation chamber 312. This prevents the moisture of the ink contained in the tank body 32 from evaporating from the air inlet 317 to the outside. In order to extend the connecting flow path 320 and prevent evaporation of the moisture, the connecting flow path 320 may be provided in a serpentine manner.

The air flowing through the first flow path 310 passes through the film 316 bonded to the convex 313. This more effectively prevents the ink contained in the tank body 32 from leaking out.

The chambers 330, 340 and 350 are described. As shown in FIG. 16, the liquid chamber 340 forms a vertically long space in the liquid supply attitude. The liquid outlet 349 is located near the lowermost end of the liquid chamber 340 in the liquid supply attitude. This reduces the possibility that the air flow into the printer 12 during ink supply from the container unit 50 to the printer 12.

Referring to FIG. 16, the air chamber 330 is divided into the connecting flow path-side chamber 332 and the opening-side chamber 331 by the partition wall 334 as the restrictor. The partition wall 334 is extended from the opposed wall member 370*b* to the open wall member 370. The partition wall 334 has a first constraint wall 334V and a second constraint wall 334Y. The first constraint wall 334V crosses the vertical direction in the liquid supply attitude (i.e., attitude with the Z-axis direction set to the vertical direction). According to this embodiment, the first constraint wall 334V is extended horizontally in the liquid supply attitude. The first constraint wall 334V is located between the one-end opening 351 and the air chamber opening 318 in the vertical direction (Z-axis direction) in the liquid supply attitude. The second constraint wall 334Y is continuous with the first constraint wall 334V. The second constraint wall 334Y crosses the vertical direction in the liquid receiving attitude (i.e., attitude with the Y-axis direction set to the vertical direction). According to this embodiment, the second constraint wall 334Y is extended horizontally in the liquid receiving attitude. The second constraint wall 334Y is located between the one-end opening 351 and the air chamber opening 318 in the vertical direction (X-axis direction) in the liquid receiving attitude. The second constraint wall 334Y has a partition wall opening 335 to connect the opening-side chamber 331 with the connecting flow path-side chamber 332. According to this embodiment, the partition wall opening 335 is formed by cutting out a specific part of the second constraint wall 334Y that comes into contact with the film 34. This readily forms the partition wall opening 335.

The air chamber 330 is formed in an approximate rectangular columnar shape. Among the inner surfaces of the wall members forming and parting the air chamber 330, the lowermost face (first face) in the liquid supply attitude forms a first air chamber bottom face 330Vf, and the uppermost face (second face) in the liquid supply attitude forms a first air chamber top face 330Va. Among the inner surfaces of the wall members forming and parting the air chamber 330, the lowermost face (third face) in the liquid receiving attitude is a second air chamber bottom face 330Vc, and the uppermost face (fourth face) in the liquid receiving attitude is a second air chamber top face 330Ve. In the attitude where one end of the container unit 50 equipped with the four ink tanks 30 (i.e., the first side cover member 56, FIG. 5) is located at the lowermost position in the container unit 50 (i.e., stacked attitude), the lowermost face (fifth face) forms a third air chamber bottom face 330Vb. According to this embodiment, the third air chamber bottom face 330Vb corresponds to the surface of the film 34. In the stacked attitude, the uppermost face (sixth face) forms a third air chamber top face 330Vd. According to this embodiment, the third air chamber top face 330Vd corresponds to the inner surface of the opposed wall member 370*b*.

The opening-side chamber 331 of the air chamber 330 includes a salient 330Z, which projects from the side wall member 370*c*4 into the opening-side chamber 331. An edge face 330Za as one end face of the salient 330Z is located in the air chamber 330 without coming into contact with any of the wall members forming and parting the air chamber 330. Part of the first flow path 310 (FIG. 13) is formed inside the salient 330Z. The edge face 330Za of the salient 330Z has an opening, which serves as the air chamber opening 318.

In the liquid supply attitude with the Z-axis negative direction set to the vertically downward direction, the air chamber opening 318 is placed preset distances away from the first air chamber bottom face 330Vf and from the first air chamber top face 330Va in the vertical direction. In other words, the air chamber opening 318 is placed separately from both the first air chamber bottom face 330Vf and the first air chamber top face 330Va. Among a number of attitudes of the ink tank 30, in the highly probable liquid supply attitude and in its inverted attitude, even when ink flows from the liquid chamber 340 into the air chamber 330, this arrangement reduces the possibility that ink flows through the air chamber opening 318 into the first flow path 310.

In the liquid receiving attitude with the X-axis negative direction set to the vertically downward direction, the air chamber opening 318 is placed preset distances away from the second air chamber bottom face 330Vc and from the second air chamber top face 330Ve in the vertical direction. In other words, the air chamber opening 318 is placed separately from both the second air chamber bottom face 330Vc and the second air chamber top face 330Ve. Among a number of attitudes of the ink tank 30, in the highly probable liquid receiving attitude and in its inverted attitude, even when ink flows from the liquid chamber 340 into the air chamber 330, this arrangement reduces the possibility that ink flows through the air chamber opening 318 into the first flow path 310.

The air chamber opening 318 is placed preset distances away from all the inner wall faces defining the air chamber 330, which include the first, second and third air chamber bottom faces 330Vf, 330Vc and 330Vb and the first, second and third air chamber top faces 330Va, 330Ve and 330Vd. In other words, the air chamber opening 318 is placed separately from all the inner wall faces parting the air chamber 330. Even when ink flows from the liquid chamber 340 into the air chamber 330, this arrangement reduces the possibility that ink flows through the air chamber opening 318 into the first flow path 310 in any of various attitudes of the container unit 50.

According to this embodiment, the ink tank 30 has the salient 330Z projecting from the side wall member 370*c*4 into the air chamber 330, and part of the first flow path 310 (FIG. 13) including the air chamber opening 318 is formed in the salient 330Z. The air chamber opening 318 can thus be readily placed at the position away from all the inner faces of the wall members forming the air chamber 330 (for example, third air chamber bottom face 330Vb).

The ink tank 30 has the partition wall 334 in the middle of the pathway from the second flow path (liquid connection path) 350 to the air chamber opening 318. Even when ink flows from the liquid chamber 340 into the air chamber 330, the partition wall 334 restricts the flow of ink toward the air chamber opening 318. This decreases the possibility that ink reaches the air chamber opening 318 and thereby further reduces the possibility that ink flows through the air chamber opening 318 into the first flow path 310.

According to the embodiment described above, the container unit 50 has the bottom cover member 57 that forms the bottom face 570W in the liquid receiving attitude (FIG. 6). This enables the container unit 60 to be stably placed on the mounting surface for supplying ink to the printer 12. The bottom cover member 57 has the concaves 579Z formed as the liquid retainer on the opposed face 570Y (FIGS. 7A and 7C). Even when ink is present on the bottom cover member 57, the ink is retained in the concaves 579Z. This decreases the possibility that ink flows out of the container unit 50 and thereby reduces the possibility that the mounting surface of the container unit 50 is stained with ink.

In the ink tank 30 according to this embodiment, the air chamber opening 318 at one end of the first flow path 310 is provided away from all the wall members defining the air chamber 330 (FIG. 16). Even when ink flows from the liquid chamber 340 into the air chamber 330, this reduces the possibility that ink flows through the air chamber opening 318 into the first flow path 310. This further decreases the possibility that the film 316 as the gas-liquid separation membrane located in the middle of the first flow path 310 is wetted with ink, thus preventing deterioration of the original function of the film 316 and allows the air to be introduced into the ink tank 30 via the first flow path 310.

B. Second Embodiment and Third Embodiment

Figure 18A:
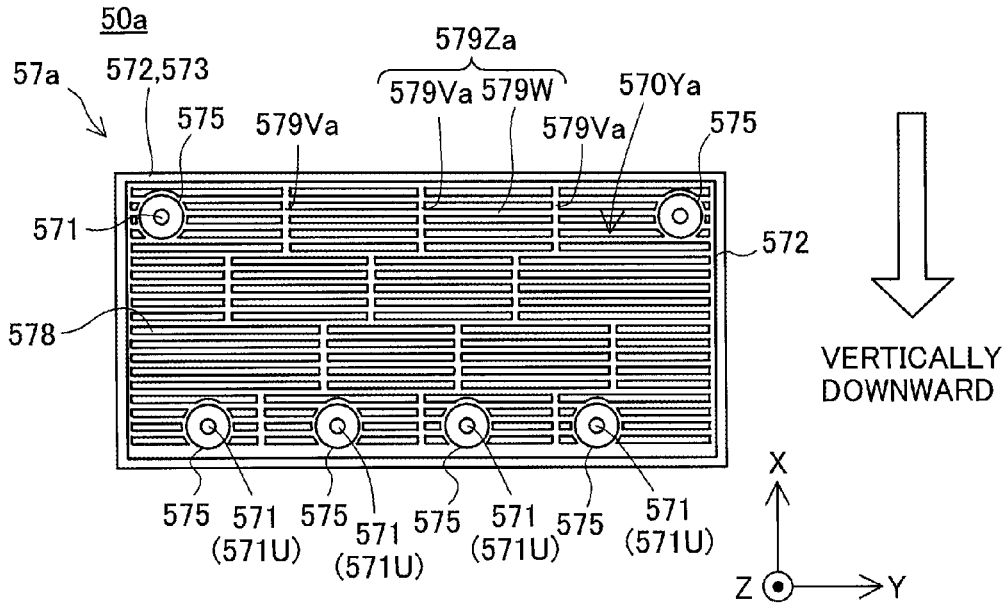
FIG. 18A schematically illustrates concaves 579Za formed as the liquid retainer on an opposed face 570Ya of the bottom cover member 57*a* according to the second embodiment.
Figure 18B:
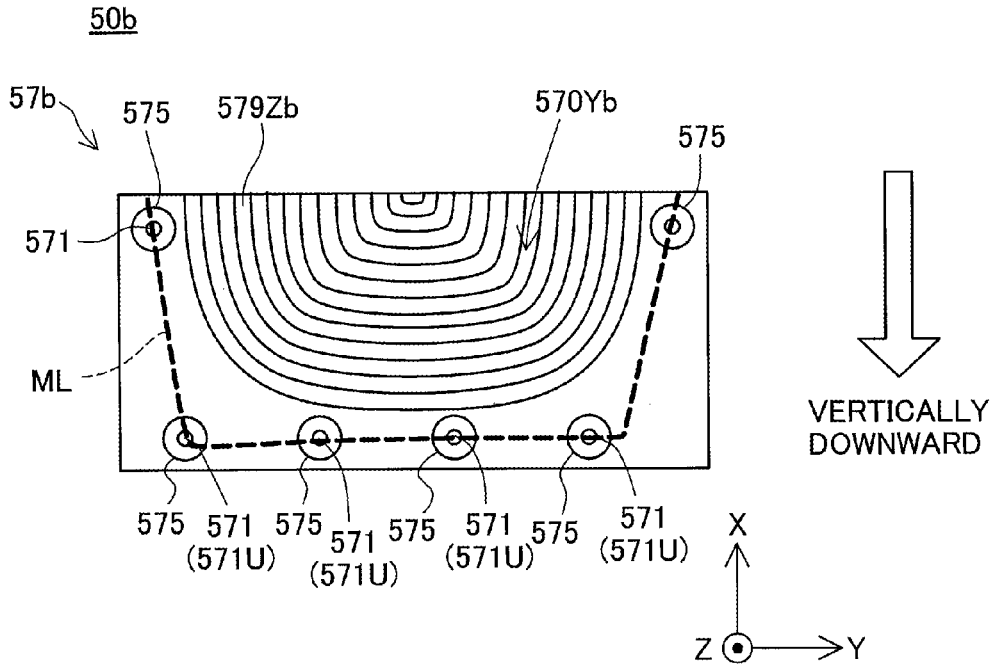
FIG. 18B schematically illustrates concaves 579Zb formed as the liquid retainer on an opposed face 570Yb of the bottom cover member 57*b* according to the third embodiment.

FIGS. 18A and 18B illustrate a bottom cover member 57*a* according to a second embodiment and a bottom cover member 57*b* according to a third embodiment. FIG. 18A schematically illustrates concaves 579Za formed as the liquid retainer on an opposed face 570Ya of the bottom cover member 57*a* according to the second embodiment. FIG. 18B schematically illustrates concaves 579Zb formed as the liquid retainer on an opposed face 570Yb of the bottom cover member 57*b* according to the third embodiment. The differences of the second and third embodiments from the first embodiment described above are the structures of the concaves 579Za and the concaves 579Zb. Otherwise the container units 50*a* and 50*b* and the liquid ejection system of the second and third embodiments have identical structures with those of the first embodiment. The like components are expressed by the like symbols and are not specifically described here.

Referring to FIG. 18A, the bottom cover member 57*a* of the second embodiment has the concaves 579Za formed as the liquid retainer on the opposed face 570Ya. The concaves 579Za include a plurality of first concaves 579W and a plurality of second concaves 579Va, which are disposed to cross each other.

Like the first embodiment, the plurality of first concaves 579W are extended in the horizontal direction (i.e., Y-axis direction or first direction) throughout the longitudinal direction of a bottom cover base 578 in the liquid receiving attitude of the container unit 50*a*. The plurality of second concaves 579Va are extended in the vertical direction (i.e., X-axis direction or second direction) in the liquid receiving attitude and are arranged in zigzag. In other words, the respective second concaves 579Va are formed not as continuous lines but as short lines across the area of the first concaves 579W in the vertical direction (X-axis direction) in the liquid receiving attitude. The sizes of the first concaves 579W and the second concaves 579Va are not specifically limited but may be dimensions for sufficiently retaining ink by capillarity.

As described above, the container unit 50*a* according to the second embodiment has the concaves 579Za formed on the opposed face 570Ya of the bottom cover member 57*a* to retain ink. Like the first embodiment, this reduces the possibility that ink flows out of the container unit 50*a*. Additionally, the plurality of second concaves 579Va are arranged in zigzag in the container unit 50*a* of this embodiment. This arrangement of the plurality of first concaves 579W and the plurality of second concaves 579Va ensures smooth diffusion of ink that is present in a specific area of the concaves 579Za. Such diffusion increases the surface area of ink retained in the concaves 579Za and accelerates vaporization of ink. This further decreases the possibility that ink flows out of the container unit 50*a*.

Referring to FIG. 18B, the bottom cover member 57*b* of the third embodiment has the concaves 579Zb (also called "third concaves 579Zb") formed as the liquid retainer on the opposed face 570Yb. The concaves 579Zb are grooves extended along an imaginary line ML successively connecting the plurality of adjacent openings 571 without crossing the imaginary line ML. More specifically, the respective concaves 579Zb are arranged not to cross any of the plurality of openings 571. The size of the concaves 579Zb is not specifically limited but may be dimensions for sufficiently retaining ink by capillarity.

As described above, the container unit 50*b* according to the third embodiment has the concaves 579Zb formed on the opposed face 570Yb of the bottom cover member 57*b* to retain ink. Like the first embodiment, this reduces the possibility that ink flows out of the container unit 50*b*. Additionally, the plurality of concaves 579Zb are extended along the imaginary line ML in the container unit 50*b* of this embodiment. Even when ink moves within the concaves 579Zb, this arrangement effectively prevents the moving ink from reaching the plurality of openings 571. This reduces the possibility that ink flows out through the openings 571.

C. Modifications

Among the various features of the invention included in the above embodiments, those other than the features disclosed in independent claims are additional and supplementary and may be omitted according to the requirements. The invention is not limited to the above embodiments or examples but various variants and modifications may be made to the embodiments without departing from the scope of the invention. Some of possible modifications are described below.

C-1. Modification 1

Figure 19:
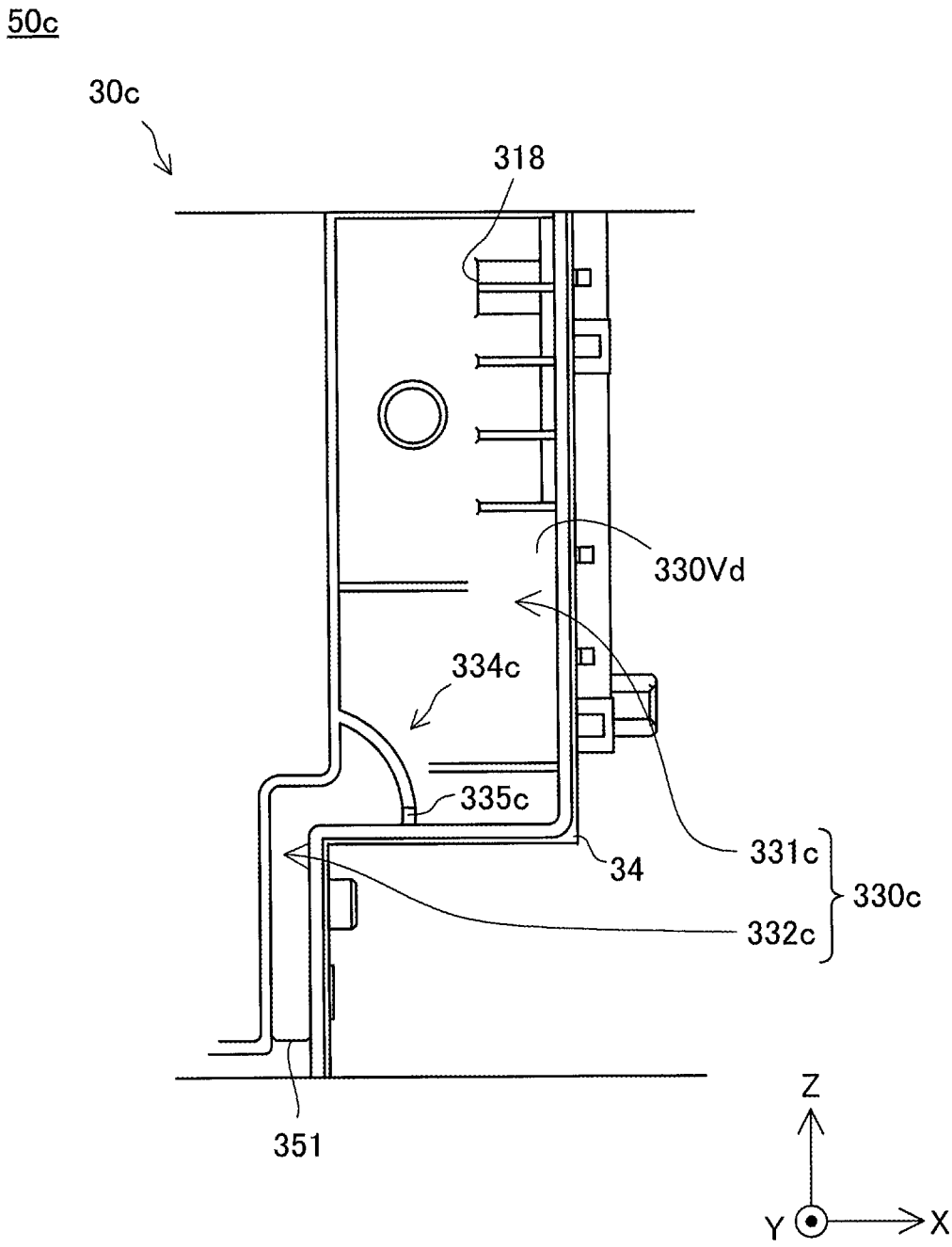
FIG. 19 illustrates a first modification.

FIG. 19 illustrates a first modification. More specifically FIG. 19 illustrates an air chamber 330*c* included in an ink tank 30*c* according to the first modification. The different from the first embodiment described above is the structure of a partition wall 334*c* as the restrictor. Otherwise the liquid ejection system 1 including the container unit 50 according to this first modification has the identical structure with that of the first embodiment. The like components are expressed by the like symbols and are not specifically described here.

Like the partition wall 334 of the first embodiment, the partition wall 334*c* of this modification divides the air chamber 330*c* into an opening-side chamber 331*c* with an air chamber opening 318 and a connecting flow path-side chamber 332*c* with an one-end opening 351. The partition wall 334*c* is formed in an arc shape. The partition wall 334*c* also has a partition wall opening 335*c* formed by cutting out a specific part of the partition wall 334*c* coming into contact with a film 34, so as to connect the opening-side chamber 331*c* with the connecting flow path-side chamber 332*c*.

Like the embodiment described above, the arc-shaped partition wall 334*c* effectively restricts the flow of ink toward the air chamber opening 318, when ink flows from the liquid chamber 340 into the air chamber 330.

In the embodiment or the first modification described above, the partition wall 334 (FIG. 17) or the partition wall 334*c* (FIG. 19) parting the air chamber 330 or 330*c* is used as the restrictor. This is, however, not essential but any other suitable structure may be provided in the middle of the pathway from the second flow path 350 (liquid connection path 350) to the air chamber opening 318 (hereinafter simply referred to as "pathway"), in order to restrict the ink flow from the second flow path 350 toward the air chamber opening 318. The restrictor may thus adopt any structure of making the flow resistance in a specific part of the pathway higher than the flow resistance in the remaining part of the pathway.

For example, a check valve may be provided in the middle of the pathway from the second flow path 350 to the air chamber opening 318 in the air chamber 330. The check valve permits passage of the fluid flow from the air chamber opening 318 toward the second flow path 350, while blocking the fluid flow from the second flow path 350 toward the air chamber opening 318. Alternatively a long serpentine flow path may be provided in the middle of the pathway.

According to another modification, only a wall crossing the vertical direction in the liquid supply attitude of the container unit 50 (for example, first constraint wall 334V in the first embodiment; FIG. 17) may be provided in the middle of the pathway from the second flow path 350 to the air chamber opening 318. The wall crossing the vertical direction may not be a horizontal wall. For example, in the liquid supply attitude of the container unit 50, the first constraint wall 334V may be inclined at a preset angle (for example, not less than 0 degree and not greater than 45 degrees) to the horizontal direction. The wall crossing the vertical direction restricts the flow of ink from the second flow path 350 toward the air chamber opening 318 in the ink tank. Especially in the liquid supply attitude and its inverted attitude, even when ink flows from the liquid chamber 340 into the air chamber 330, this structure reduces the possibility that the inflow ink reaches the air chamber opening 318.

According to still another modification, only a wall crossing the vertical direction in the liquid receiving attitude of the container unit 50 (for example, second constraint wall 334Y in the first embodiment; FIG. 17) may be provided in the middle of the pathway from the second flow path 350 to the air chamber opening 318. The wall crossing the vertical direction may not be a horizontal wall. For example, in the liquid receiving attitude of the container unit 50, the second constraint wall 334Y may be inclined at a preset angle (for example, not less than 0 degree and not greater than 45 degrees) to the horizontal direction. The wall crossing the vertical direction restricts the flow of ink from the second flow path 350 toward the air chamber opening 318 in the ink tank. Especially in the liquid receiving attitude and its inverted attitude, even when ink flows from the liquid chamber 340 into the air chamber 330, this structure reduces the possibility that the inflow ink reaches the air chamber opening 318.

C-2. Modification 2

In the first and the second embodiments described above, the first concaves 579W provided on the bottom cover member 57 or 57*a* are extended in the horizontal direction in the liquid receiving attitude (FIGS. 7A and 7B and FIG. 18A). This structure is, however, not essential. The first concaves 579W may be extended in a first direction including a horizontal component.

For example, in the liquid receiving attitude, the first concaves 579W may be inclined in a preset angle range (for example, range of greater than 0 degree and not greater than 45 degree) to the horizontal direction. In the liquid receiving attitude of the container unit 50 or 50*a*, this arrangement also effectively prevents the ink present in the first concave 579W from moving vertically downward by gravity.

C-3. Modification 3

In the first and the second embodiments described above, the second concaves 579V or 579Va provided on the bottom cover member 57 or 57*a* are extended in the vertical direction in the liquid receiving attitude (FIGS. 7A and 7B and FIG. 18A). This structure is, however, not essential. The second concaves 579V or 579Va crossing the first concaves 579W may be extended in a second direction including a vertical component in the liquid receiving attitude. For example, in the liquid receiving attitude, the second concaves 579V or 579Va may be inclined in a preset angle range (for example, range of greater than 0 degree and not greater than 45 degree) to the vertical direction. In the liquid receiving attitude of the container unit 50 or 50*a*, the inclined second concaves 579V or 579Va effectively prevent ink from being retained in one of the plurality of first concaves 579W. The ink in one first concave 579W can thus be diffused to the other first concaves 579W via the second concaves 579V or 579Va. This accordingly accelerates vaporization of the ink present on the bottom cover member 57 or 57*a*.

C-4. Modification 4

In the embodiments described above, the bottom cover member 57, 57*a* or 57*b* has the concaves 579Z, 579Za or 579Zb formed as the liquid retainer on the opposed face 570Y, 570Ya or 570Yb. Another structure may be adopted for retaining the liquid. For example, instead of forming the concaves 579Z, 579Za or 579Zb on the opposed face 570Y, 570Ya or 570Yb, a porous member (for example, sponge) having the property for retaining ink by capillarity (water absorbing property) may be provided on the opposed face 570Y, 570Ya or 570Yb. Like the embodiments described above, this structure reduces the possibility that ink flows out of the container unit 50, 50*a* or 50*b*. The concaves 579Z, 579Za or 579Zb may be used in combination with the porous member.

C-5. Modification 5

In the embodiments described above, the concaves 579Z, 579Za or 579Zb are formed as grooves. This structure is, however, not essential. For example, the concaves may be hemispherical or rectangular parallelepiped recesses. A plurality of concaves in a specified shape may be provided throughout the opposed face 570Y, 570Ya or 570Yb. The size of such concaves is not specifically limited but may be dimensions for sufficiently retaining ink by capillarity. Like the embodiments described above, the concaves formed as such hemispherical or rectangular parallelepiped recesses also reduce the possibility that ink flows out of the container unit 50, 50*a* or 50*b*.

C-6. Modification 6

According to the above embodiment, the air chamber opening 318 is placed preset distances away from the respective inner faces of the wall members forming and parting the air chamber 330. This structure is, however, not essential. The air chamber opening 318 is required to be placed preset distances away from at least the first face or the lowermost face and the second face or the uppermost face in the liquid supply attitude and the third face or the lowermost face and the fourth face or the uppermost face in the liquid receiving attitude. In the highly probable attitudes (i.e., liquid supply attitude and its inverted attitude and liquid receiving attitude and its inverted attitude) among a number of attitudes of the ink tank 30, this arrangement effectively reduces the possibility that ink flows into the air chamber opening 318.

C-7. Modification 7

The above embodiments describe the ink tank 30 used as the liquid container for the printer 12. This is, however, not restrictive but the present invention is applicable to a liquid container with a liquid fill port for supplying a liquid to any of various liquid ejection apparatuses, for example, an apparatus equipped with a color material ejection head, such as liquid crystal display, an apparatus equipped with an electrode material (conductive paste) ejection head used for formation of electrodes, such as organic EL display or surface emitting display (FED), an apparatus equipped with a bio-organic matter ejection head used for production of biochips, an apparatus equipped with a sample ejection head as a precision pipette, a printing apparatus or a micro dispenser. In application of the liquid container for any of these various liquid ejection apparatuses, the liquid container contains a liquid (e.g., color material, conductive paste or bio-organic matter) corresponding to the type of the liquid to be ejected from the liquid ejection apparatus. The invention is also applicable to a liquid ejection system including one of these various liquid ejection apparatuses and a liquid container corresponding to the liquid ejection apparatus.

What is claimed is:

1. A container unit located outside of a liquid ejection apparatus and configured to supply a liquid to the liquid ejection apparatus via a connection path, comprising:

a liquid container configured to contain the liquid, the liquid container having a liquid fill port for pouring the liquid into the liquid container; and a bottom cover member attached to the liquid container and configured to form a bottom face that comes into contact with a mounting surface of the container unit in a liquid supply attitude of the liquid container, in which the liquid is supplied to the liquid ejection apparatus, wherein the bottom cover member has a liquid retainer provided on an opposed face to retain the liquid flow into the opposed face, the opposed face being provided on an opposite side to the bottom face and being opposed to the liquid container.

2. The container unit according to claim 1, wherein the liquid retainer is a recess formed on the opposed face.

3. The container unit according to claim 2, wherein the bottom cover member is a vertically-angled relative to the mounting surface in a liquid receiving attitude of the container unit, in which the liquid is poured into the liquid container, and the recess includes a first concave formed in a groove shape and extended in a first direction including a horizontal component in the liquid receiving attitude.

4. The container unit according to claim 3, wherein the recess includes a second concave formed in a groove shape to cross the first concave and extended in a second direction including a vertical component in the liquid receiving attitude.

5. The container unit according to claim 4, wherein the bottom cover member comprises a plurality of the first concaves and a plurality of the second concaves, and the plurality of first concaves and the plurality of second concaves are arranged to form a lattice-like pattern.

6. The container unit according to claim 4, wherein the bottom cover member comprises a plurality of the first concaves and a plurality of the second concaves, and the plurality of second concaves are arranged in zigzag.

7. The container unit according to claim 2, wherein the bottom cover member further comprises:

a plurality of openings or notches formed to penetrate from the opposed face to the bottom face; and a third concave formed in a groove shape and extended along an imaginary line without crossing the imaginary line, the imaginary line successively connecting the plurality of adjacent openings or notches.

8. The container unit according to claim 7, wherein the bottom cover member further comprises:

a plurality of circumferential rims, each being provided on the opposed face side to surround periphery of each of the plurality of openings or notches and being protruded from the opposed face.

9. The container unit according to claim 1, wherein the bottom cover member further comprises:

an opening or a notch formed to penetrate from the opposed face to the bottom face; and a circumferential rim provided on the opposed face side to surround periphery of the opening or the notch and protruded from the opposed face.

10. The container unit according to claim 1, wherein the bottom cover member further comprises a cover wall member projecting from periphery of the bottom cover member toward a side on which the liquid container is mounted.

11. A liquid ejection system, comprising:

the container unit according to claim 1;

the liquid ejection apparatus having a head for ejecting the liquid onto an object; and the connection path arranged to connect the container unit to the liquid ejection apparatus and supply the liquid contained in the container unit to the liquid ejection apparatus.

* * * * *